US010518544B2

(12) United States Patent
Sugiura

(10) Patent No.: US 10,518,544 B2
(45) Date of Patent: Dec. 31, 2019

(54) LIQUID DISCHARGE APPARATUS AND HEAD UNIT

(71) Applicant: Brother Kogyo Kabushiki Kaisha, Nagoya-shi, Aichi-ken (JP)

(72) Inventor: Keita Sugiura, Toyokawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/202,312

(22) Filed: Nov. 28, 2018

(65) Prior Publication Data

US 2019/0291447 A1 Sep. 26, 2019

(30) Foreign Application Priority Data

Mar. 26, 2018 (JP) ..... 2018-058828

(51) Int. Cl.
*B41J 2/175* (2006.01)

(52) U.S. Cl.
CPC ..... *B41J 2/17523* (2013.01)

(58) Field of Classification Search
CPC . B41J 2/175; B41J 2/17523; B41J 2/14; B41J 2/14048; B41J 2/14209; B41J 2/14233; B41J 2/14274
See application file for complete search history.

(56) References Cited

U.S. PATENT DOCUMENTS 8,919,917 B2 * 12/2014 Koike ..... B41J 2/125 347/22
9,102,163 B2 * 8/2015 Shibata ..... B41J 2/19
9,272,524 B1 * 3/2016 Sugitani ..... B41J 2/17596
2010/0085396 A1 * 4/2010 Yokota ..... B41J 2/14233 347/7

FOREIGN PATENT DOCUMENTS

JP 2016-144911 A 8/2016

* cited by examiner

*Primary Examiner* — Anh T Vo
(74) *Attorney, Agent, or Firm* — Banner & Witcoff, Ltd.

(57) ABSTRACT

There is provided a liquid discharge apparatus including: a liquid discharge head having a nozzle; a carriage; a tank; a first connection channel connecting the liquid discharge head and the tank; and a second connection channel connecting the liquid discharge head and the tank and communicating with the first connection channel via the liquid discharge head. The first connection channel has a first channel portion moving in a scanning direction of the carriage together with the carriage and a first damper provided closer to the nozzle than the first channel portion. The second connection channel has a second channel portion moving in the scanning direction together with the carriage and a second damper provided closer to the nozzle than the second channel portion. The first damper is different in compliance from the second damper.

21 Claims, 17 Drawing Sheets

Fig. 13

| CARRIAGE MOVING DIRECTION | CARRIAGE MOVING VELOCITY |
|---|---|
| LEFT | V1 |
| RIGHT | V2(>V1) |

LIQUID DISCHARGE APPARATUS AND HEAD UNIT

CROSS REFERENCE TO RELATED APPLICATION

The present application claims priority from Japanese Patent Application No. 2018-058828 filed on Mar. 26, 2018, the disclosure of which is incorporated herein by reference in its entirety.

BACKGROUND

Field of the Invention

The present disclosure relates to a liquid discharge apparatus configured to discharge liquid from a nozzle and a head unit configuring the liquid discharge apparatus.

Description of the Related Art

In a conventional multifunction peripheral, a carriage carries a recording head and a buffer tank having a first storage chamber. The first storage chamber is connected to a second storage chamber of an ink tank via two tubes. Each of the two tubes has a check valve. The check valve provided in one of the tubes allows ink flow from the second storage chamber to the first storage chamber and restricts ink flow from the first storage chamber to the second storage chamber. The check valve provided in the other tube allows ink flow from the first storage chamber to the second storage chamber and restricts ink flow from the second storage chamber to the first storage chamber. In the multifunction peripheral configured as described above, when the carriage reciprocates in a scanning direction, pressure is generated in ink in the first storage chamber and the tube. This circulates ink between the first storage chamber and the second storage chamber. Accordingly, ink can circulate without a pump or the like.

SUMMARY

Although the above multifunction peripheral does not need any pump to circulate ink, a check valve is required to be provided in the tube connecting the first storage chamber and the second storage chamber. This increases the number of components of the multifunction peripheral.

An object of the present disclosure is to provide a liquid discharge apparatus that allows a liquid in a liquid discharge head to flow without using a pump and without increasing the number of components of the liquid discharge apparatus, and a head unit configuring the liquid discharge apparatus.

According to an aspect of the present disclosure, there is provided a liquid discharge apparatus including: a liquid discharge head including at least one nozzle; a carriage configured to carry the liquid discharge head and configured to move in a scanning direction; a tank configured to store liquid; a first connection channel connecting the liquid discharge head and the tank; and a second connection channel connecting the liquid discharge head and the tank and communicating with the first connection channel via the liquid discharge head. The first connection channel includes a first channel portion and a first damper, the first channel portion extending in the scanning direction and configured to move in the scanning direction together with the carriage, the first damper provided closer to the at least one nozzle than the first channel portion and configured to inhibit pressure change in the liquid. The second connection channel includes a second channel portion and a second damper, the second channel portion extending in the scanning direction and configured to move in the scanning direction together with the carriage, the second damper provided closer to the at least one nozzle than the second channel portion and configured to inhibit pressure change in the liquid. The first damper is different in compliance from the second damper.

BRIEF DESCRIPTION OF THE DRAWINGS

FIG. 13 is a table for explaining a correlation between a carriage moving direction and a carriage moving velocity.

DESCRIPTION OF THE EMBODIMENTS

<First Embodiment>

A first embodiment of the present disclosure is explained below.

<Configuration of Printer 1>

Figure 1:
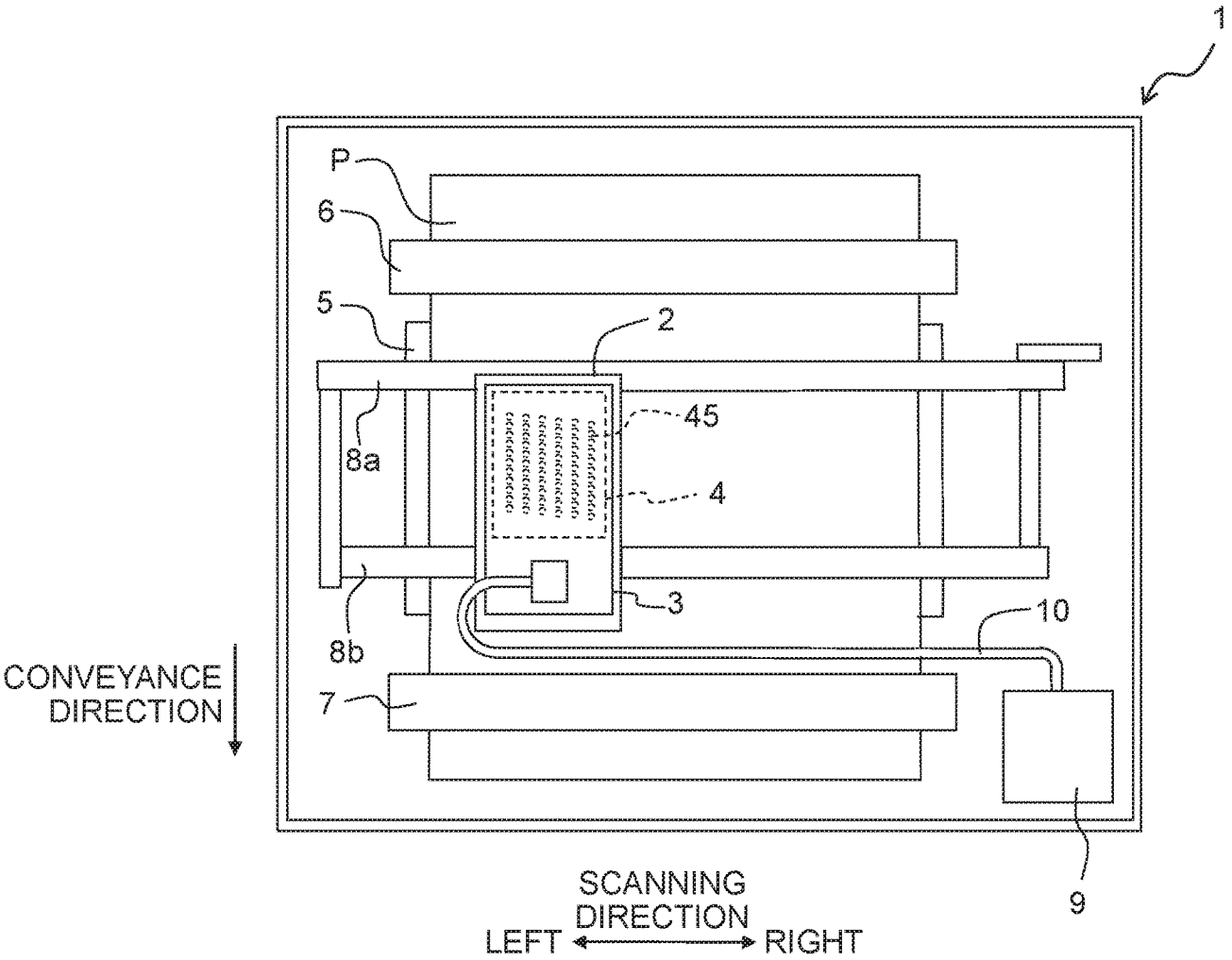
FIG. 1 depicts a schematic configuration of a printer 1 according to a first embodiment.

As depicted in FIG. 1, a printer 1 according to the first embodiment (a liquid discharge apparatus of the present disclosure) includes a carriage 2, a subtank 3, an ink-jet head 4 (a liquid discharge head of the present disclosure), a platen 5, conveyance rollers 6 and 7, and the like.

The carriage 2 is supported by two guide rails 8*a* and 8*b* extending in a scanning direction. The carriage 2 is connected to a carriage motor 56 (see FIG. 6) via a belt (not depicted) or the like. Driving the carriage motor 56 moves the carriage 2 along the guide rails 8*a* and 8*b* in the scanning direction. In the following explanation, right and left sides in the scanning direction are defined as indicated in FIG. 1.

The subtank 3 is carried on the carriage 2. The subtank 3 includes ink channels that include, for example, dampers 72 and 73 described below. The subtank 3 is connected to an ink tank 9 (a liquid tank of the present disclosure) provided outside the carriage 2 via a tube 10. The ink tank 9 stores ink and may be an ink cartridge that is removably attached to the printer 1 or a tank secured to the printer 1. Ink stored in the ink tank 9 is supplied to the subtank 3 via the tube 10.

The ink-jet head 4 is attached to the subtank 3. Ink is supplied from the subtank 3 to the ink-jet head 4, and discharged from nozzles 45 arranged on a lower surface of the subtank 3.

The platen 5 is disposed below the ink-jet head 4 to face a lower surface of the ink-jet head 4. The platen 5 extends over the entire length of recording paper P in the scanning direction to support the recording paper P from below.

The conveyance rollers 6 and 7 extend in the scanning direction. The conveyance roller 6 is disposed upstream of the platen 5 in a conveyance direction orthogonal to the scanning direction, and the conveyance roller 7 is disposed downstream of the platen 5 in the conveyance direction. The conveyance rollers 6 and 7 are connected to a conveyance motor 57 (see FIG. 6) via a gear or the like (not depicted). Driving the conveyance motor 57 rotates the conveyance rollers 6 and 7 to convey the recording paper P in the conveyance direction.

<Ink-Jet Head 4>

Figure 2:
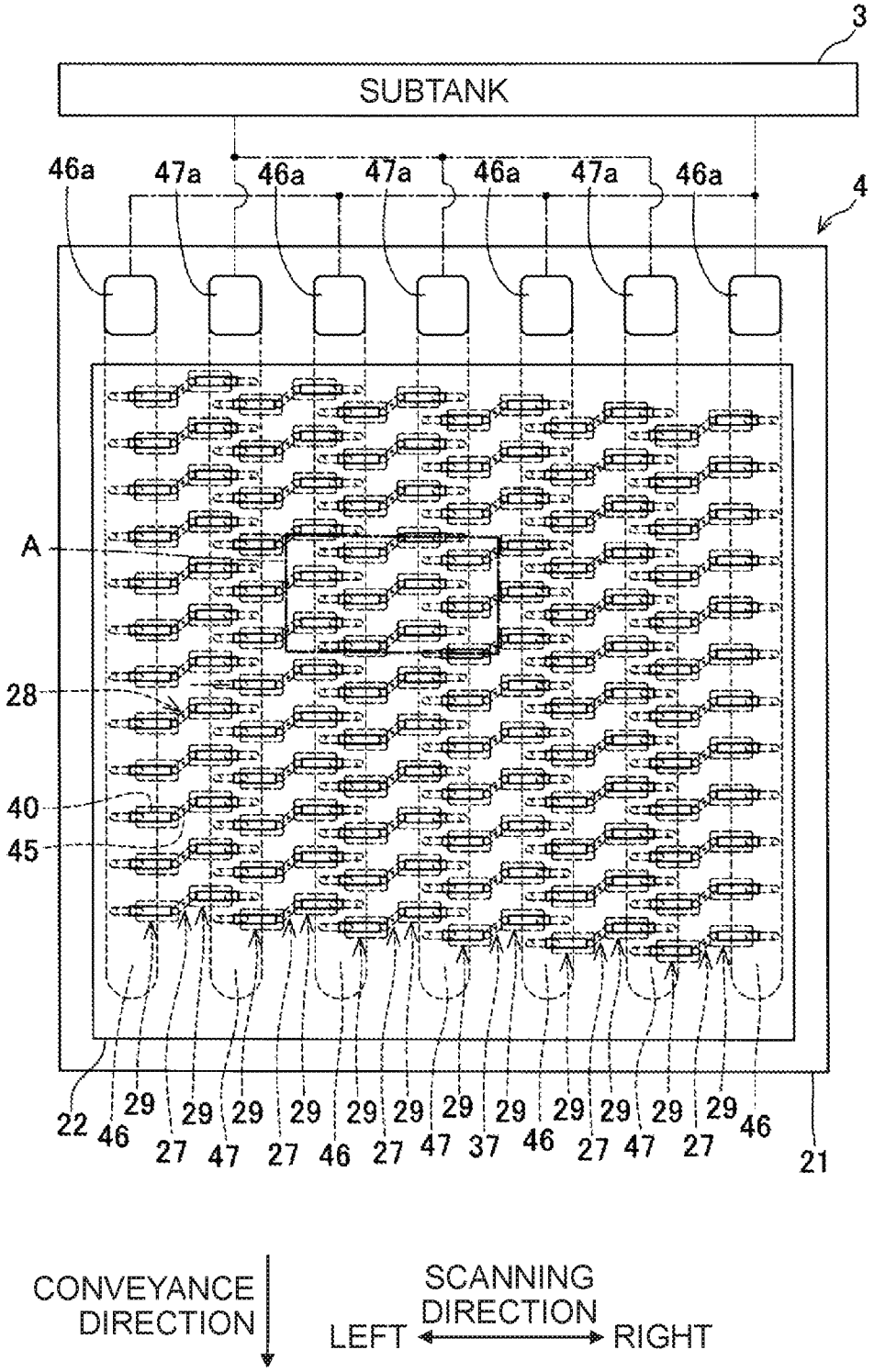
FIG. 2 is a plan view of an ink-jet head 4.
Figure 3:
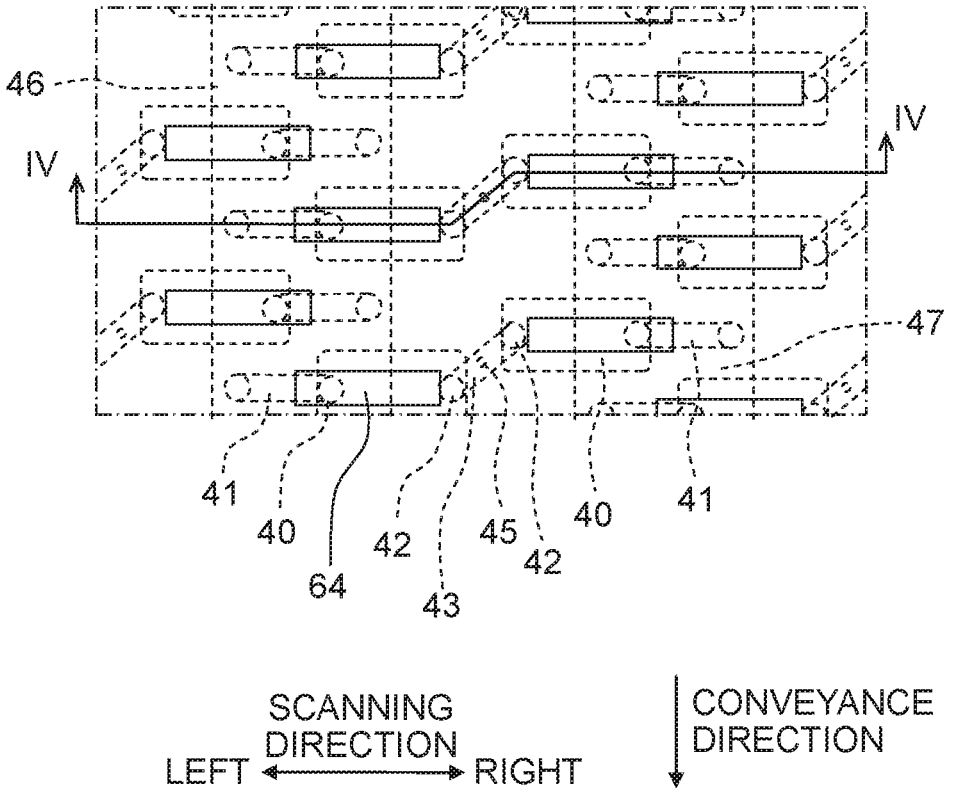
FIG. 3 is an enlarged view of a section A of FIG. 2.
Figure 4:
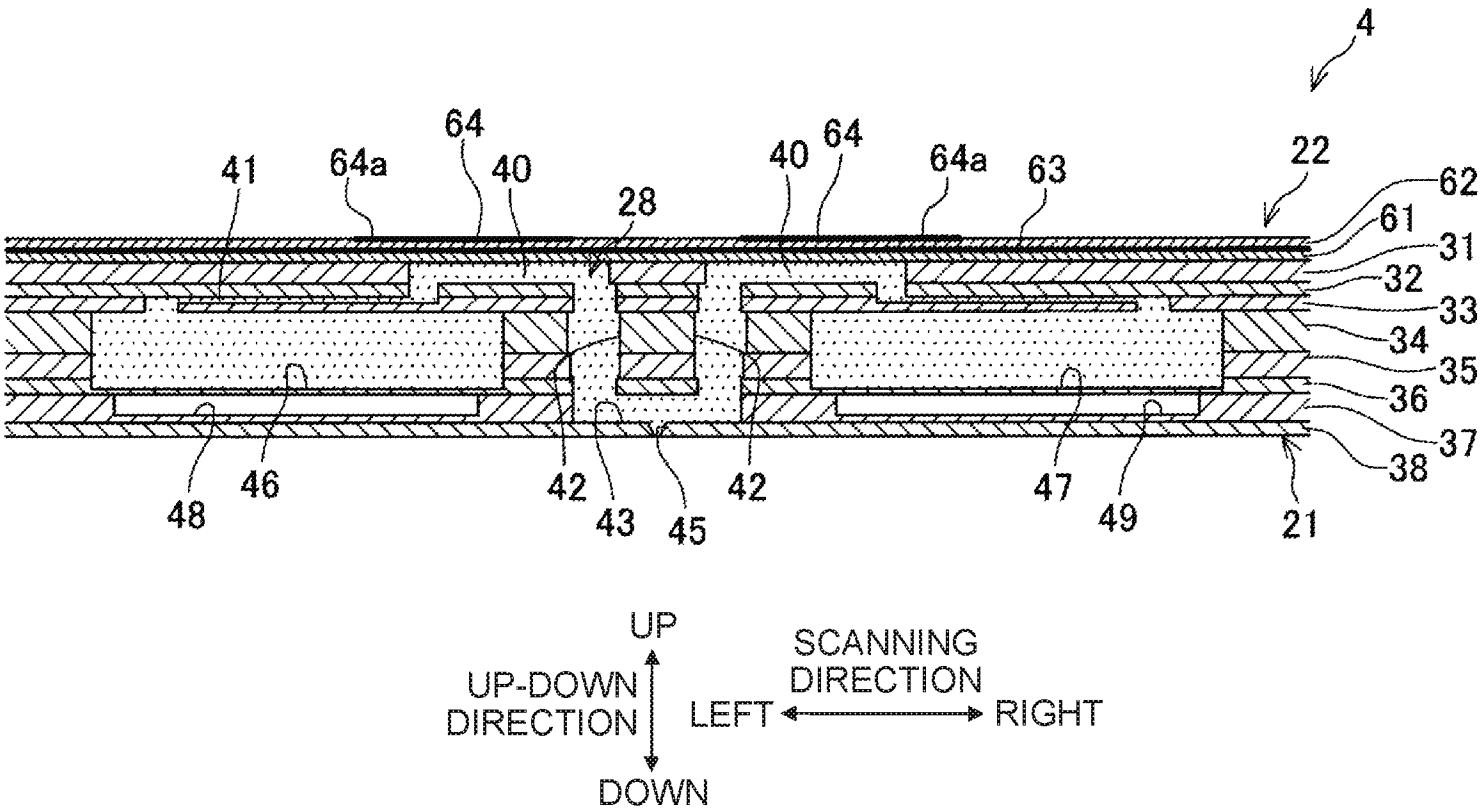
FIG. 4 is a cross-sectional view taken along a line IV-IV in FIG. 3.

Details of the ink-jet head 4 are explained below. As depicted in FIGS. 2 to 4, the ink-jet head 4 includes a channel unit 21 in which ink channels including the nozzles 45 and pressure chambers 40 described below are formed, and a piezoelectric actuator 22 that applies pressure to ink in each pressure chamber 40.

<Channel Unit 21>

The channel unit 21 is formed by stacking eight plates 31 to 38 in that order starting from an upper side in an up-down direction, as depicted in FIG. 4. The channel unit 21 includes the pressure chambers 40, throttling channels 41, descender channels 42, connection channels 43, the nozzles 45, four pieces of first manifold 46 (a first common channel of the present disclosure), and three pieces of second manifold 47 (a second common channel of the present disclosure).

The pressure chambers 40 are arranged in the plate 31. Each of the pressure chambers 40 has a substantially rectangular planar shape of which longitudinal direction is the scanning direction. The pressure chambers 40 arrayed in the conveyance direction form a pressure chamber row 29. In the plate 31, 12 rows of pressure chamber row 29 are arranged in the scanning direction. The pressure chambers 40 belonging to one of the pressure chamber rows 29 are positioned to be shifted or deviated, in the conveyance direction, from the pressure chambers 40 belonging to the pressure chamber row 29 adjacent thereto.

The throttling channels 41 extend over the plates 32 and 33. Each of the throttling channels 41 is provided corresponding to one of the pressure chambers 40. The throttling channels 41 corresponding to the pressure chambers 40, which form an odd-numbered pressure chamber row 29 from the left in the scanning direction, are connected to left ends in the scanning direction of the pressure chambers 40 so that the throttling channels 41 extend leftward in the scanning direction from the connection portions with the pressure chambers 40. The throttling channels 41 corresponding to the pressure chambers 40, which form an even-numbered pressure chamber row 29 from the left in the scanning direction, are connected to right ends in the scanning direction of the pressure chambers 40 so that the throttling channels 41 extend rightward in the scanning direction from the connection portions with the pressure chambers 40.

Each of the descender channels 42 is formed by a through hole in the plates 32 to 37 that overlap with each other in the up-down direction. Each of the descender channels 42 is provided corresponding to one of the pressure chambers 40. The descender channels 42 corresponding to the pressure chambers 40, which form an odd-numbered pressure chamber row 29 from the left in the scanning direction, are connected to right ends in the scanning direction of the pressure chambers 40 so that the descender channels 42 extend downward from the connection portions with the pressure chambers 40. The descender channels 42 corresponding to the pressure chambers 40, which form an even-numbered pressure chamber row 29 from the left in the scanning direction, are connected to left ends in the scanning direction of the pressure chambers 40 so that the descender channels 42 extend downward from the connection portions with the pressure chambers 40.

The connection channels 43 are formed in the plate 37. Each of the connection channels 43 extends in a horizontal direction that is inclined to the scanning direction and the conveyance direction to connect a lower end of the descender channel 42 connected to the pressure chamber 40 configuring one of adjacent two pressure chamber rows 29, and a lower end of the descender channel 42 connected to the pressure chamber 40 configuring the other pressure chamber row 29. More specifically, the plate 37 has through holes each formed by parts of two descender channels 42 and the connection channel 43, as depicted in FIG. 4.

The nozzles 45 are formed in the plate 38. Each of the nozzles 45 is provided corresponding to one of the connection channels 43. The nozzle 45 is connected to a center portion of the connection channel 43.

The channel unit 21 includes individual channels 28 each including: one of the nozzles 45; one of the connection channels 43 connected to that nozzle 45; two descender channels 42 connected to that connection channel 43; two pressure chambers 40 connected to the two descender channels 42; and two throttling channels 41 connected to the two pressure chambers 40. The individual channels 28 arrayed in the conveyance direction form an individual channel row 27. In the channel unit 21, six rows of individual channel row 27 are arranged in the scanning direction.

As depicted in FIGS. 2 to 4, each of the four pieces of the first manifold 46 is formed by a through hole in the plates 34 and 35 and a recess in an upper surface of the plate 36. The through hole and the recess overlap with each other in the up-down direction. The four pieces of the first manifold 46 extend in the conveyance direction at intervals in the scanning direction. Of the four pieces of the first manifold 46, the first manifold 46 positioned at the leftmost side in the scanning direction is connected to ends, of the throttling channels 41 connected to the pressure chambers 40 that form the first pressure chamber row 29 in the order starting from the left in the scanning direction, on the opposite side of the pressure chambers 40; the first manifold 46 positioned at the second leftmost side in the scanning direction is connected to ends, of the throttling channels 41 connected to the pressure chambers 40 that form the fourth and fifth pressure chamber rows 29 in the order starting from the left in the scanning direction, on the opposite side of the pressure chambers 40; the first manifold 46 positioned at the third leftmost side in the scanning direction is connected to ends, of the throttling channels 41 connected to the pressure chambers 40 that form the eight and ninth pressure chamber rows 29 in the order starting from the left in the scanning direction, on the opposite side of the pressure chambers 40; and the first manifold 46 positioned at the rightmost side in the scanning direction is connected to ends, of the throttling channels 41 connected to the pressure chambers 40 that form the twelfth pressure chamber row 29 in the order starting from the left in the scanning direction, on the opposite side of the pressure chambers 40.

Each of the three pieces of the second manifold 47 is configured by a through hole in the plates 34 and 35 and a recess in the upper surface of the plate 36. The through hole and the recess overlap with each other in the up-down direction. The three pieces of the second manifold 47 extend in the conveyance direction and are disposed between adjacent first manifolds 46 in the scanning direction. Of the three pieces of the second manifold 47, the second manifold 47 positioned at the leftmost side in the scanning direction is connected to ends, of the throttling channels 41 connected to the pressure chambers 40 that form the second and third pressure chamber rows 29 in the order starting from the left in the scanning direction, on the opposite side of the pressure chambers 40; the second manifold 47 positioned at the second leftmost side in the scanning direction is connected to ends, of the throttling channels 41 connected to the pressure chambers 40 that form the sixth and seventh pressure chamber rows 29 in the order starting from the left in the scanning direction, on the opposite side of the pressure chambers 40; and the second manifold 47 positioned at the rightmost side in the scanning direction is connected to ends, of the throttling channels 41 connected to the pressure chambers 40 that form the tenth and eleventh pressure chamber rows 29 in the order starting from the left in the scanning direction, on the opposite side of the pressure chambers 40.

In the first embodiment, a portion of the individual channel 28 that includes: a portion of the connection channel 43 that allows the nozzle 45 to communicate with the first manifold 46; one of the descender channels 42; one of the pressure chambers 40; and one of the throttling channels 41 corresponds to a first communicating portion of the present disclosure. A portion of the individual channel 28 that includes: a portion of the connection channel 43 that allows the nozzle 45 to communicate with the second manifold 47; one of the descender channels 42; one of the pressure chambers 40; and one of the throttling channels 41 corresponds to a second communicating portion of the present disclosure.

An upstream end in the conveyance direction of each of the first manifolds 46 extends over the plates 31 to 36 in the up-down direction. A connection port 46*a* is provided at an upper end of each of the first manifolds 46. The connection ports 46*a* of the four pieces of the first manifold 46 are connected to each other, and then connected to the subtank 3.

An upstream end in the conveyance direction of each of the second manifolds 47 extends over the plates 31 to 36 in the up-down direction. A connection port 47*a* is provided at an upper end of each of the second manifolds 47. The connection ports 47*a* of the three pieces of the second manifold 47 are connected to each other, and then connected to the subtank 3.

The plate 37 includes a damper chamber 48 that overlaps with the first manifold 46 in the up-down direction and is separated from the first manifold 46. Pressure change in the first manifold 46 is inhibited by deformation of a partition wall that is configured by a lower end of the plate 36 and separates the first manifold 46 from the dumber chamber 48. The plate 37 includes a damper chamber 49 that overlaps with the second manifold 47 in the up-down direction and is separated from the second manifold 47. Pressure change in the second manifold 47 is inhibited by deformation of a partition wall that is configured by the lower end of the plate 36 and separates the second manifold 47 from the dumber chamber 49.

<Piezoelectric Actuator 22>

As depicted in FIGS. 2 to 4, the piezoelectric actuator 22 includes two piezoelectric layers 61 and 62, a common electrode 63, and individual electrodes 64. The piezoelectric layers 61 and 62 are made by using a piezoelectric material composed primarily of lead zirconate titanate (PZT), which is a mixed crystal of lead titanate and lead zirconate. The piezoelectric layer 61 is disposed on an upper surface of the channel unit 21, and the piezoelectric layer 62 is disposed on an upper surface of the piezoelectric layer 61. Unlike the piezoelectric layer 62, the piezoelectric layer 61 may be made by using, for example, an insulating material other than the piezoelectric material, such as a synthetic resin material.

The common electrode 63 is disposed between the piezoelectric layer 61 and the piezoelectric layer 62. The common electrode 63 continuously extends over almost the entire area of the piezoelectric layers 61 and 62. The common electrode 63 is kept at the ground potential. Each of the individual electrodes 64 is provided corresponding to one of the pressure chambers 40. The individual electrode 64 has a substantially rectangular planar shape of which longitudinal direction is the scanning direction. Each of the individual electrodes 64 is disposed to overlap with a center portion of the corresponding one of the pressure chambers 40 in the up-down direction. An end, of the individual electrode 64, on the side opposite to the descender channel 42 in the scanning direction extends to a position not overlapping with the pressure chamber 40, and a front portion of that end is a connection terminal 64*a* for connection with a trace member (not depicted). The connection terminals 64*a* of the individual electrodes 64 are connected to a driver IC (not depicted) via trace members (not depicted). The driver IC selectively applies any one of the ground potential and a predefined drive potential (e.g., approximately 20V) to each of the individual electrodes 64. Corresponding to the above arrangement of the common electrode 63 and the individual electrodes 64, a portion of the piezoelectric layer 62 sandwiched between each individual electrode 64 and the common electrode 63 is an active portion polarized in the thickness direction.

Here, a method of driving the piezoelectric actuator 22 to discharge ink from each nozzle 45 is explained. When the piezoelectric actuator 22 is in a standby state in which no ink is discharged from each nozzle 45, all the individual electrodes 64 are kept at the ground potential similarly to the common electrode 63. When ink is discharged from one of the nozzles 45, the potential of two individual electrodes 64 corresponding to the two pressure chambers 40 that are connected to that nozzle 45 is switched from the ground potential to the drive potential.

That switching generates an electrical field parallel to the polarized direction in two active portions corresponding to the two individual electrodes 64, thus contracting the two active portions in a horizontal direction perpendicular to the polarized direction. This deforms portions, of the piezoelectric layers 61 and 62, overlapping with the two piezoelectric chambers 40 in the up-down direction so that the portions entirely become convex toward the pressure chambers 40. This reduces the volume of each pressure chamber 40 to increase the pressure in each pressure chamber 40, thereby discharging ink from the nozzle 45 communicating with each pressure chamber 40. After discharging ink from the nozzle 45, the potential of the two individual electrodes 64 returns to the ground potential and the piezoelectric layers 61 and 62 return to the state before deformed.

<Subtank 3>

Figure 5A:
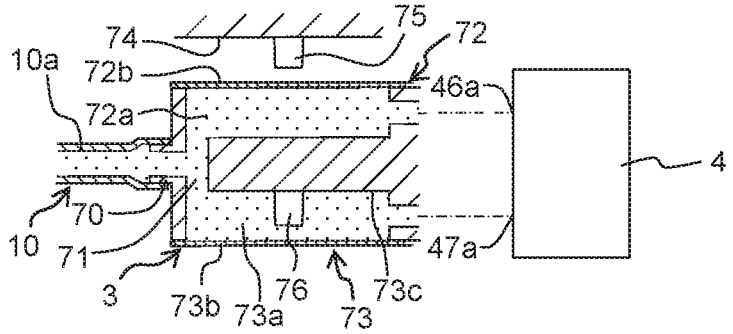
FIG. 5A is a cross-sectional view of a portion including dampers 72 and 73 of a subtank 3 along a scanning direction.

Subsequently, the subtank 3 is explained. As depicted in FIG. 5A, the subtank 3 includes a tube connection portion 70, a branched channel 71, a first dumber 72, a second dumber 73, and the like. The tube connection portion 70 faces the left side in the scanning direction. The tube 10 is connected to the tube connection portion 70 from the left side in the scanning direction. The tube 10 has a portion 10*a* that extends leftward in the scanning direction from the tube connection portion 70.

In the first embodiment, the tube 10 corresponds to a tank-side channel of the present disclosure. The portion 10*a* of the tube 10 that extends leftward in the scanning direction from the tube connection portion 70 functions as both a first channel portion and a second channel portion of the present disclosure. The combination of the ink-jet head 4 and the subtank 3 and the tube 10 corresponds to a head unit of the present disclosure. Note that FIG. 5A omits illustration of portions of the subtank 3 forming channels between the dampers 72, 73 and the ink-jet head 4. The same is true of FIGS. 5B and 5C, FIGS. 12A to 12C, FIGS. 16A to 16C, and FIGS. 17A to 17C.

The branched channel 71 is connected to the tube connection portion 70 and branches at the tube connection portion 70 to extend in the up-down direction.

The first dumber 72 has a first dumber chamber 72*a* and a first dumber film 72*b*. The first dumber chamber 72*a* is a flat space connected to an upper end of the branched channel 71. The first dumber chamber 72*a* is connected to the connection port 46*a* via an ink channel (not depicted) formed in the subtank 3.

Figure 5B:
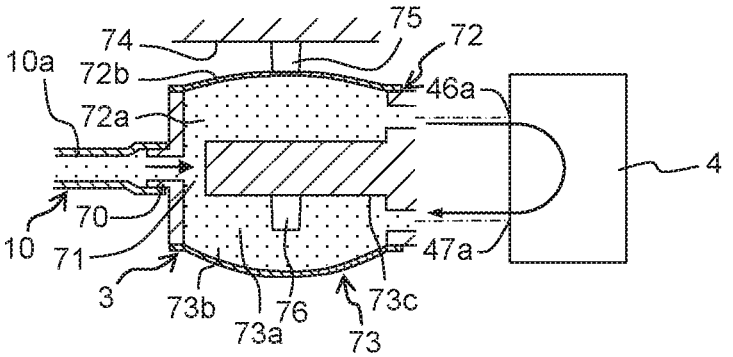
FIG. 5B depicts a state in which a carriage 2 is positioned on a left side in the scanning direction and FIG. 5B corresponds to FIG. 5A.
Figure 5C:
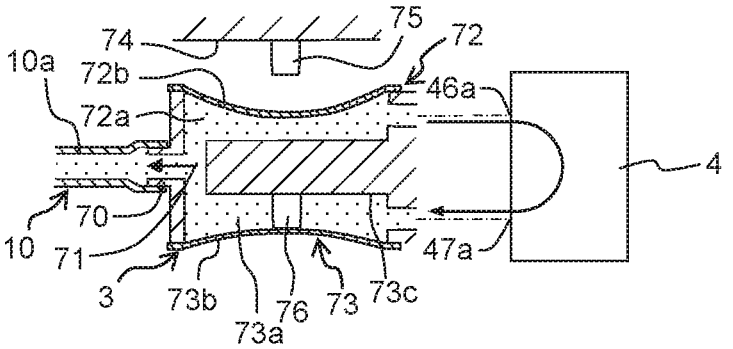
FIG. 5C depicts a state in which the carriage 2 is positioned on a right side in the scanning direction and FIG. 5C corresponds to FIG. 5A.
Figure 5C:
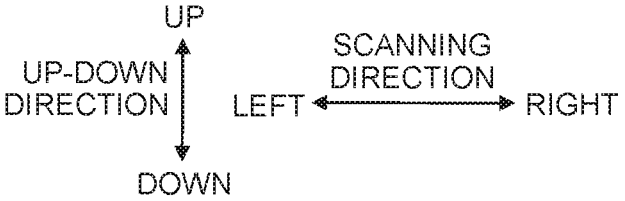

The first damper film 72*b* is a film functioning as an upper wall of the first damper chamber 72*a*. The first damper film 72*b* is deformed depending on pressure change in the first damper chamber 72*a* to inhibit the pressure change in the first damper chamber 72*a*. Specifically, when positive pressure is generated in the first damper chamber 72*a*, as depicted in FIG. 5B, the first damper film 72*b* is deformed to be convex upward (the outside of the first damper chamber 72*a*) to inhibit pressure increase in the first damper chamber 72*a*. When negative pressure is generated in the first damper chamber 72*a*, as depicted in FIG. 5C, the first damper film 72*b* is deformed to be convex downward (the inside of the first damper chamber 72*a*) to inhibit pressure decrease in the first damper chamber 72*a*.

The subtank 3 has a facing surface 74 that is disposed above the first damper film 72*b* to face the first damper film 72*b*. The facing surface 74 is provided with a projection 75 (a first regulating portion of the present disclosure) that protrudes downward toward the first damper film 72*b*. The protrusion 75 comes into contact with the first damper film 72*b* to regulate further deformation of the first damper film 72*b* when the first damper film 72*b* is deformed to be convex upward by a predefined deformation amount.

In that configuration, a largest deformation amount of the first damper film 72*b* when the first damper film 72*b* is deformed to be convex upward is smaller than a largest deformation amount of the first damper film 72*b* when the first damper film 72*b* is deformed to be convex downward. Thus, compliance of the first damper 72 when positive pressure is generated in the first damper chamber 72*a* is smaller than compliance of the first damper 72 when negative pressure is generated in the first damper chamber 72*a*. For example, compliance of the first damper 72 when negative pressure is generated in the first damper chamber 72*a* is approximately 1.5 to 2 times of compliance of the first damper 72 when positive pressure is generated in the first damper chamber 72*a*.

The second damper 73 includes a second damper chamber 73*a* and a second damper film 73*b*. The second damper chamber 73*a* is a flat space connected to a lower end of the branched channel 71. The second dumber chamber 73*a* is connected to the connection port 47*a* via an ink channel (not depicted) formed in the subtank 3.

The second damper film 73*b* is a film functioning as a lower wall of the second damper chamber 73*a*. The second damper film 73*b* is deformed depending on pressure change in the second damper chamber 73*a* to inhibit pressure change in the second damper chamber 73*a*. Specifically, when positive pressure is generated in the second damper chamber 73*a*, as depicted in FIG. 5B, the second damper film 73*b* is deformed to be convex downward (the outside of the second damper chamber 73*a*) to inhibit pressure increase in the second damper chamber 73*a*. When negative pressure is generated in the second damper chamber 73*a*, as depicted in FIG. 5C, the second damper film 73*b* is deformed to be convex upward (the inside of the second damper chamber 73*a*) to inhibit pressure decrease in the second damper chamber 73*a*.

The second damper chamber 73*a* has an inner wall surface 73*c* that is disposed on the upper side of the second damper chamber 73*a* to face the second damper film 73*b*. The inner wall surface 73*c* is provided with a projection 76 (a second regulating portion of the present disclosure) that protrudes downward toward the second damper film 73*b*. The protrusion 76 comes into contact with the second damper film 73*b* to regulate further deformation of the second damper film 73*b* when the second damper film 73*b* is deformed to be convex upward by a predefined deformation amount.

In that configuration, a largest deformation amount of the second damper film 73*b* when the second damper film 73*b* is deformed to be convex downward is larger than a largest deformation amount of the second damper film 73*b* when the second damper film 73*b* is deformed to be convex upward. Thus, compliance of the second damper 73 when positive pressure is generated in the second damper chamber 73*a* is greater than compliance of the second damper 73 when negative pressure is generated in the second damper chamber 73*a*. For example, compliance of the second damper 73 when positive pressure is generated in the second damper chamber 73*a* is approximately 1.5 to 2 times of compliance of the second damper 73 when negative pressure is generated in the second damper chamber 73*a*.

Discharging ink from the nozzle 45 generates negative pressure in the damper chambers 72*a* and 73*a*. In the first embodiment, however, when ink is discharged from all the nozzles 45 to generate negative pressure in the second damper chambers 73*a*, the second damper films 73*b* do not come into contact with the projections 76. When negative pressure greater than the case in which ink is discharged from all the nozzles 45 is generated in the second damper chamber 73*a*, the second damper film 73*b* comes into contact with the projection 76 to regulate further deformation.

Lower surfaces of the projections 75 and 76 may be curved surfaces along curves generated when the damper films 72*b* and 73*b* are convex upward. In that case, the damper films 72*b* and 73*b* are brought into surface contact with the projections 75 and 76 when the damper films 72*b* and 73*b* are deformed to be convex upward. This can prevent damage to the damper films 72*b* and 73*b* which may otherwise be caused by a load intensely applied on one point of each of the damper films 72*b* and 73*b*. Or, rigidity of lower ends of the projections 75 and 76 may be lower than rigidity of other portions of the projections 75 and 76. In that case also, the damper films 72*b* and 73*b* come into contact with portions having low rigidity of the projections 75 and 76 when the damper films 72*b* and 73*b* are deformed to be convex upward. This prevents damage to the damper films 72 and 73*b*.

In the first embodiment, the first damper chamber 72*a* and the second damper chamber 73*a* have substantially the same lengths in the scanning direction, the conveyance direction, and the up-down direction, and thus the first damper chamber 72*a* and the second damper chamber 73*a* have substantially the same volume. The first damper film 72*b* and the second damper film 73*b* have substantially the same area. As described above, compliance of the first damper 72 when positive pressure is generated in the first damper chamber 72*a* is smaller than compliance of the first damper 72 when negative pressure is generated in the first damper chamber 72*a*. Further, compliance of the second damper 73 when positive pressure is generated in the second damper chamber 73*a* is greater than compliance of the second damper 73 when negative pressure is generated in the second damper chamber 73*a*.

Accordingly, compliance of the first damper 72 when positive pressure is generated in the first damper chamber 72*a* is smaller than compliance of the second damper 73 when positive pressure is generated in the second damper chamber 73*a*. Further, compliance of the first damper 72 when negative pressure is generated in the first damper chamber 72*a* is greater than compliance of the second damper 73 when negative pressure is generated in the second damper chamber 73*a*. Namely, the magnitude relation between compliance of the first damper 72 and compliance of the second damper 73 when positive pressure is generated in the damper chambers 72*a* and 73*a* is opposite to the magnitude relation between compliance of the first damper 72 and compliance of the second damper 73 when negative pressure is generated in the damper chambers 72*a* and 73*a*.

In the first embodiment, a portion, which is included in the ink channel of the subtank 3 and allows the tube connection portion 70 to communicate with the connection port 46*a*, corresponds to a first branched channel of the present disclosure. A portion, which is included in the ink channel of the subtank 3 and allows the tube connection portion 70 to communicate with the connection port 47*a*, corresponds to a second branched channel of the present disclosure.

A portion, which is included in the channel formed by the tube 10 and the subtank 3 and connects the ink tank 9 and the connection port 46*a*, corresponds to a first connection channel of the present disclosure. A portion, which is included in the channel formed by the tube 10 and the subtank 3 and connects the ink tank 9 and the connection port 47*a*, corresponds to a second connection channel of the present disclosure. The tube 10 functions as a part of the first connection channel and a part of the second connection channel.

<Electrical Configuration of Printer 1>

Figure 6:
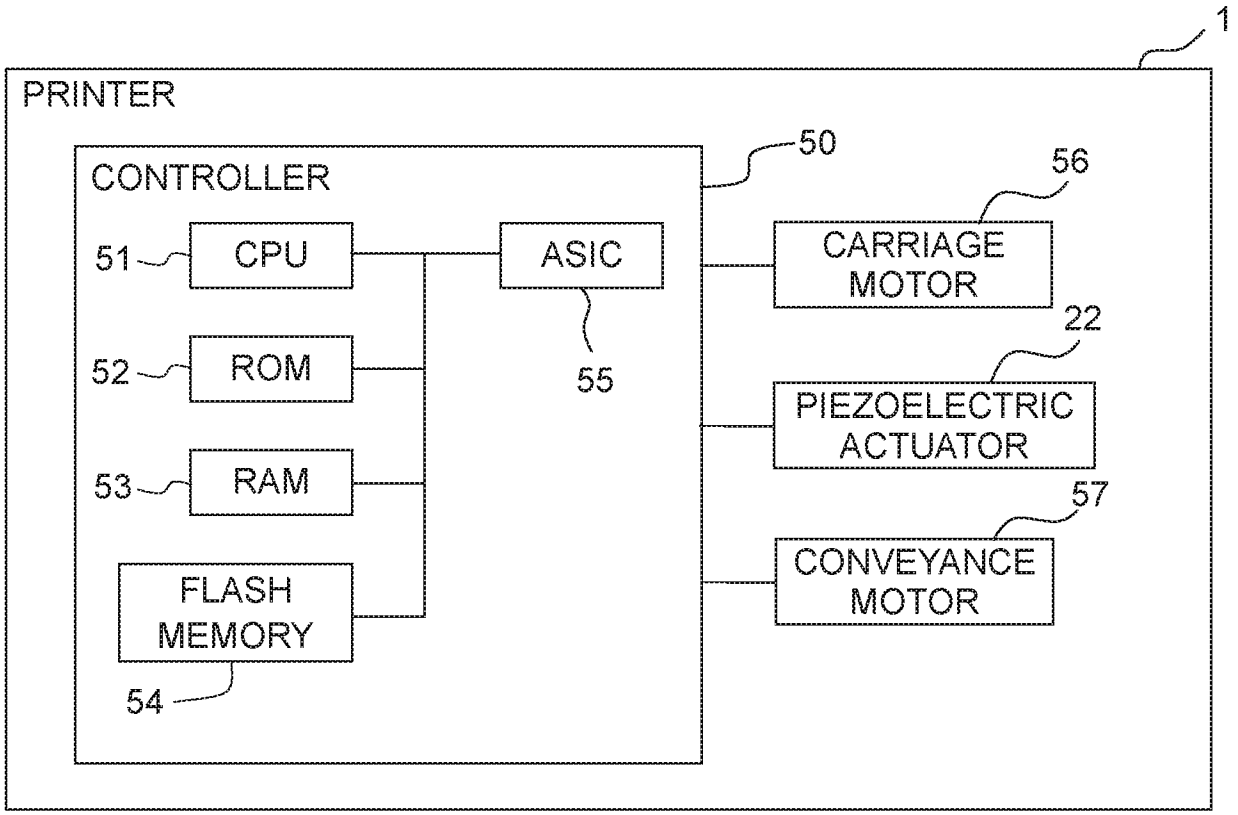
FIG. 6 is a block diagram indicating an electrical configuration of the printer 1.

Subsequently, an electrical configuration of the printer 1 is explained. Operations of the printer 1 are controlled by a controller 50. As depicted in FIG. 6, the controller 50 includes a Central Processing Unit (CPU) 51, a Read Only Memory (ROM) 52, a Random Access Memory (RAM) 53, a flash memory 54, an Application Specific Integrated Circuit (ASIC) 55, and the like. Those control the carriage motor 56, the piezoelectric actuator 22, the conveyance motor 57, and the like.

In the controller 50, only the CPU 51 may perform various kinds of processing, only the ASIC 55 may perform various kinds of processing, or the CPU 51 may cooperate with the ASIC 55 to perform various kinds of processing. In the controller 50, the CPU 51 may perform a piece of processing singly, or pieces of the CPU 51 may perform a piece of processing in a shared fashion. Or, the ASIC 55 may perform a piece of processing singly, or pieces of the ASIC 55 may perform a piece of processing in a shared fashion.

<Control by Controller 50>

Subsequently, control by the controller 50 is explained. When the printer 1 is turned on, the controller 50 performs pieces of processing indicated in the flowchart of FIG. 7.

Figure 7:
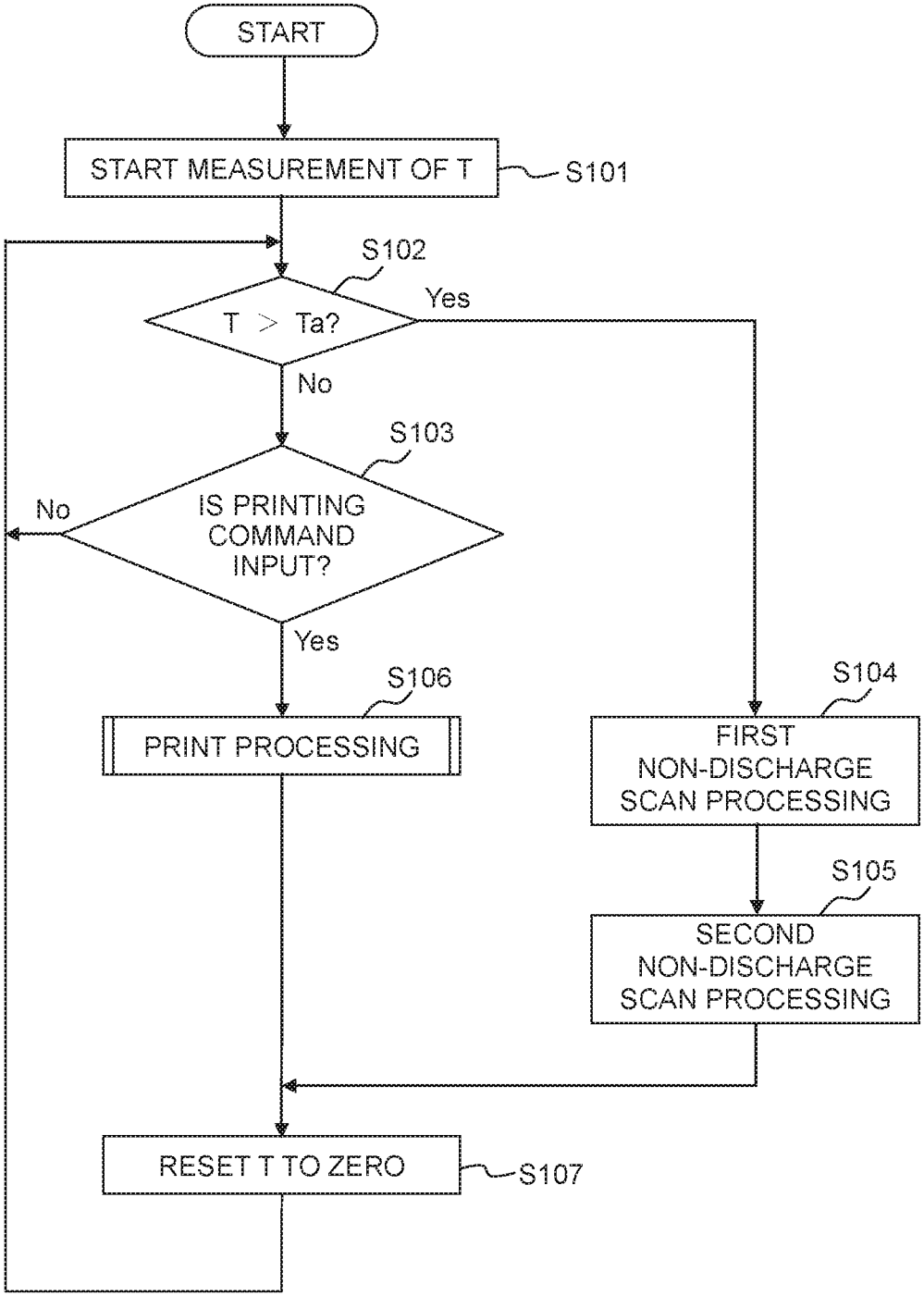
FIG. 7 is a flowchart indicating a flow of control in the printer 1.

More specifically, when the printer 1 is turned on, the controller 50 starts measurement of an elapsed time T, as indicated in FIG. 7 (S101). The controller 50 stands by when the elapsed time T is equal to or less than a predefined time Ta and no printing command is inputted (S102: NO, S103: NO).

When the elapsed time T exceeds the predefined time Ta (S102: Yes), the controller 50 executes first non-discharge scan processing (S104), and then executes second non-discharge scan processing (S105). After the first and second non-discharge scan processing, the controller 50 resets the elapsed time T to zero (S107), and returns to S102.

At the timing at which the printer 1 is turned on, the carriage 2 is positioned at a home position, which is on the right in the scanning direction of the platen 5. In the first non-discharge scan processing, the controller 50 controls the carriage motor 56 to move the carriage 2 leftward in the scanning direction. In that situation, the controller 50 performs non-discharge flushing in which the piezoelectric actuator 22 is driven to an extent that no ink is discharged from the nozzles 45 to vibrate ink in the nozzles 45. The non-discharge flushing agitates ink in the nozzles 45.

When the carriage 2 moves leftward in the scanning direction, the subtank 3 moves leftward in the scanning direction. In that situation, ink in the portion 10*a* of the tube 10 flows into the dumber chambers 72*a* and 73*a*, generating positive pressure in the damper chambers 72*a* and 73*a*. As described above, compliance of the first damper 72 when positive pressure is generated in the first damper chamber 72*a* is smaller than compliance of the second damper 73 when positive pressure is generated in the second damper chamber 73*a*. In that case, positive pressure in the first damper chamber 72*a* is greater than positive pressure in the second damper chamber 73*a*. For example, positive pressure of approximately 1.5 to 2 kPa is generated in the first damper chamber 72*a*, and positive pressure of approximately 1 kPa is generated in the second damper chamber 73*a*. The difference in positive pressure causes ink to flow from the first damper chamber 72*a* to the second damper chamber 73*a* via ink channels (the first manifold 46, the individual channels 28, and the second manifold 47) of the ink-jet head 4, as depicted in FIG. 5B. Accordingly, ink in the ink-jet head 4 is circulated.

In the second non-discharge scan processing, the controller 50 performs non-discharge flushing while controlling the carriage motor 56 to move the carriage 2 rightward in the scanning direction.

Moving the carriage 2 rightward in the scanning direction moves the subtank 3 rightward in the scanning direction. In that situation, ink in the damper chambers 72*a* and 73*a* flows into the portion 10*a* of the tube 10, generating negative pressure in the damper chambers 72*a* and 73*a*. As described above, compliance of the first damper 72 when negative pressure is generated in the first damper chamber 72*a* is greater than compliance of the second damper 73 when negative pressure is generated in the second damper chamber 73*a*. In that case, negative pressure in the first damper chamber 72*a* is smaller than negative pressure in the second damper chamber 73*a*. For example, negative pressure of approximately 1 kPa is generated in the first damper chamber 72*a*, and negative pressure of approximately 1.5 to 2 kPa is generated in the second damper chamber 73*a*. The difference in negative pressure causes ink to flow from the first damper chamber 72*a* to the second damper chamber 73*a* via ink channels of the ink-jet head 4, as depicted in FIG. 5C. Accordingly, ink in the ink-jet head 4 is circulated.

When a printing command is inputted (S103: YES), the controller 50 executes print processing (S106), resets the elapsed time T to zero (S107), and returns to S102.

Figure 8:
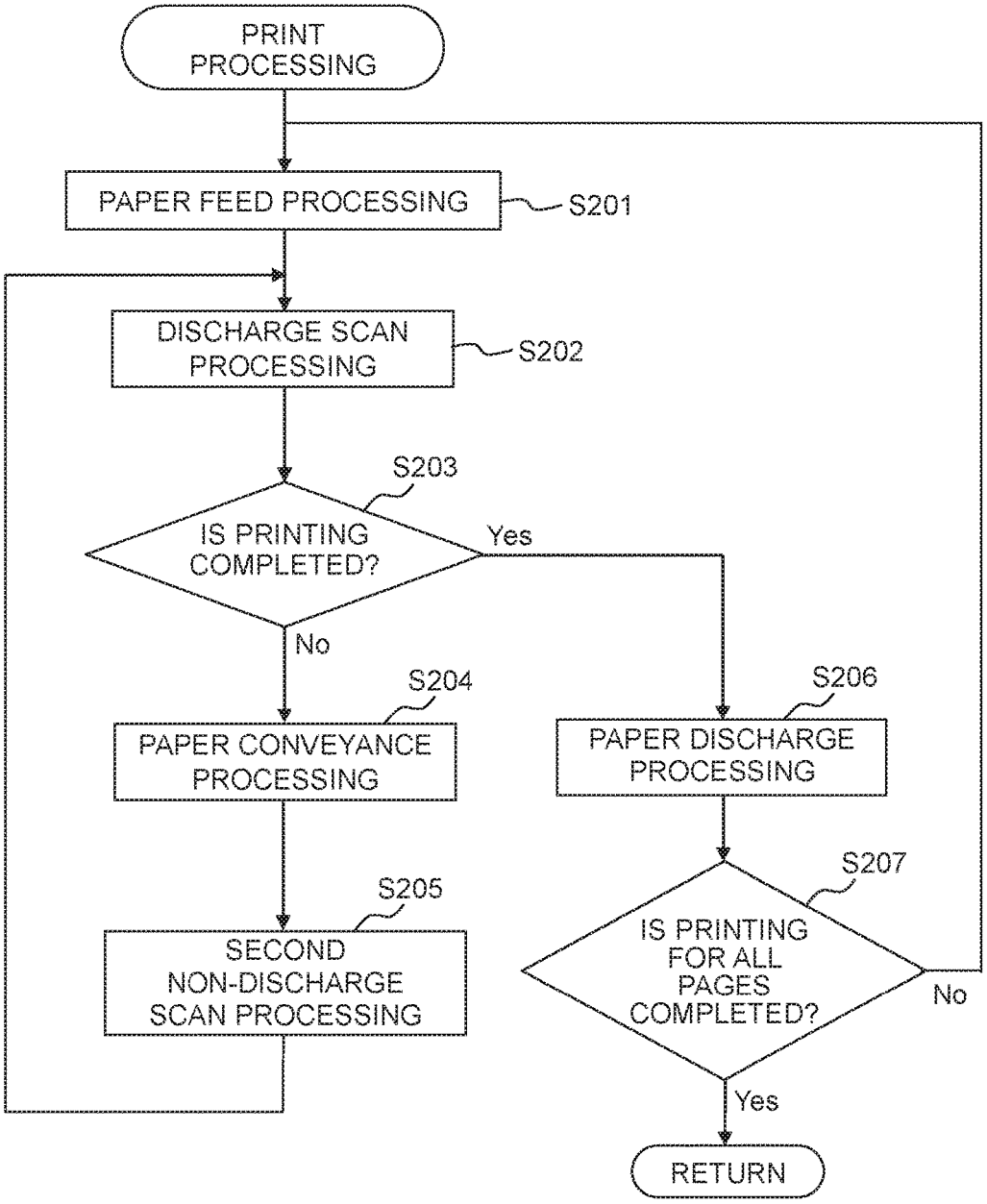
FIG. 8 is a flowchart indicating a flow of print processing indicated in FIG. 7.

In the print processing of S106, as indicated in FIG. 8, the controller 50 at first controls the conveyance roller 6 and the like to execute paper feed processing (S201) by which the recording paper P is supplied from a feed tray (not depicted). Then, the controller 50 executes discharge scan processing (S202). In the discharge scan processing, the controller 50 performs printing by driving the piezoelectric actuator 22 to discharge ink from the nozzles 45 while moving the carriage 2 leftward in the scanning direction. The movement in the scanning direction of the carriage 2 causes ink flow in the ink-jet head 4 similarly to the above.

When printing is not yet completed after the print processing (S203: NO), the controller 50 executes paper conveyance processing (S204) and the second non-discharge scan processing (S205), which is similar to S105. In the paper conveyance processing, the controller 50 controls the conveyance motor 57 to convey the recording paper P by use of the conveyance rollers 6 and 7 by a predefined amount. The rightward movement in the scanning direction of the carriage 2 in the second non-discharge scan processing (S205) causes ink flow in the ink-jet head 4 similarly to the above.

Although FIG. 8 illustrates the paper conveyance processing and the second non-discharge scan processing in that order for the convenience sake, the second non-discharge scan processing may be executed earlier than the paper conveyance processing, or the paper conveyance processing and the second non-discharge scan processing may be executed in parallel.

When printing is completed (S203: YES), the controller 50 executes paper discharge processing (S206). In the paper discharge processing, the controller 50 controls the conveyance motor 57 to discharge the recording paper P on a discharge tray (not depicted) by use of the conveyance rollers 6 and 7. Then, when printing for all pages is not yet completed (S207: NO), the controller 50 returns to S201. When printing for all pages is completed (S207: YES), the controller 50 returns to the processing indicated in FIG. 7.

<Effect>

In the first embodiment, the tube 10 communicating with the first damper chamber 72*a* and the second damper chamber 73*a* extends leftward in the scanning direction from the tube connection portion 70 that is an end on the ink-jet head 4 side of the tube 10. The tube 10 has the portion 10*a* moving in the scanning direction together with the carriage 2. Thus, as described above, movement in the scanning direction of the carriage 2 generates a pressure change in ink in the first damper chamber 72*a* and the second damper chamber 73*a*. Here, compliance of the first damper 72 is different from compliance of the second damper 73, which generates a pressure change between the first damper chamber 72*a* and the second damper chamber 73*a*. This pressure change generates ink flow in the ink-jet head 4.

In a printer in which ink is discharged from nozzles of an ink-jet head during movement in the scanning direction of the carriage, dampers are typically provided to inhibit a pressure change in ink channels. In the present disclosure, only making compliance of the first damper 72 different from compliance of the second damper 73 generates ink flow in the ink-jet head 4 during movement of the carriage 2. Namely, a pump, a check valve, and the like dedicated for ink flow generation are not required to be provided, eliminating the increase in the number of components.

According to Japanese Patent Application Laid-open No. 2016-144911, check valves are respectively provided in two tubes connecting a first storage chamber connected to a recording head and a second storage chamber. The check vale provided one of the tubes allows ink flow from the second storage chamber to the first storage chamber, and restricts ink flow from the first storage chamber to the second storage chamber. The check valve provided in the other tube allows ink flow from the first storage chamber to the second storage chamber, and restricts ink flow from the second storage chamber to the first storage chamber. In that configuration, for example, when the amount of ink to be supplied to the recording head is large (e.g., a case in which ink is discharged from many nozzles of the recording head), ink is supplied from the second storage chamber to the first storage chamber via only one of the tubes, and no ink is supplied from the second storage chamber to the first storage chamber via the other tube. This may cause a shortage of ink supply to the recording head.

Meanwhile, in the first embodiment, no check valve is provided. In that configuration, when the amount of ink to be supplied to the recording head 4 is large (e.g., a case in which ink is discharged from many nozzles 45 of the recording head 4), ink can be supplied from both the connection port 46*a* and the connection port 47*a* to the ink-jet head 4. This reduces a shortage of ink supply to the ink-jet head 4.

In the first embodiment, the magnitude relation between compliance of the first damper 72 and compliance of the second damper 73 when positive pressure is generated in the damper chambers 72*a* and 73*a* is opposite to the magnitude relation between compliance of the first damper 72 and compliance of the second damper 73 when negative pressure is generated in the damper chambers 72*a* and 73*a*. In that configuration, as described above, ink in the ink-jet head 4 can flow in the same direction both when positive pressure is generated in the damper chambers 72*a* and 73*b* and when negative pressure is generated in the damper chambers 72*a* and 73*b*.

In the first embodiment, the protrusion 75, which regulates outward deformation of the first damper film 72*b* relative to the first damper chamber 72*a*, makes compliance of the first damper 72 when positive pressure is generated in the first damper chamber 72*a* smaller than compliance of the first damper 72 when negative pressure is generated in the first damper chamber 72*a*. Further, the protrusion 76, which regulates inward deformation of the second damper film 73*b* relative to the second damper chamber 73*a*, makes compliance of the second damper 73 when positive pressure is generated in the second damper chamber 73*a* greater than compliance of the second damper 73 when negative pressure is generated in the second damper chamber 73*a*. In that configuration, the magnitude relation between compliance of the first damper 72 and compliance of the second damper 73 when positive pressure is generated in the damper chambers 72*a* and 73*a* can be opposite to the magnitude relation between compliance of the first damper 72 and compliance of the second damper 73 when negative pressure is generated in the damper chambers 72*a* and 73*a*.

In the first embodiment, the subtank 3 includes a channel portion connected to the connection portion 46*a* and including the first damper chamber 72*a* that is connected to the upper end of the branched channel 71 branching at the tube connection portion 70, and a channel portion connected to the connection portion 47*a* and including the second damper chamber 73*a* that is connected to the lower end of the branched channel 71 branching at the tube connection portion 70. This allows the ink tank 9 to be connected to the subtank 3 via the single tube 10. This simplifies the configuration of the printer 1 compared to a configuration in which the tube connecting the ink tank 9 and the connection port 46*a* is provided separately from the tube connecting the ink tank 9 and the connection portion 47*a*.

In the first embodiment, each individual channel 28 is connected to the first manifold 46 and the second manifold 47. In that configuration, ink flow generated in the ink-jet head 4 during movement in the scanning direction of the carriage 2 generates ink flow in each individual channel 28.

In the first embodiment, non-discharge flushing is performed when the carriage 2 moves in the scanning direction without discharge of ink from the nozzles 45 (e.g., the first non-discharge scan processing in S104 and the second non-discharge scan processing in S105, S205). In that configuration, ink flow generated by movement in the scanning direction of the carriage 2 causes ink in the nozzles 45 agitated by the non-discharge flushing to move away from the nozzles 45.

<Second Embodiment>

Subsequently, a second embodiment of the present disclosure is explained.

A printer according to the second embodiment includes an ink-jet head 101 (a liquid discharge head of the present disclosure) and a subtank 102, instead of the ink-jet head 4 and the subtank 3 of the printer 1 according to the first embodiment.

<Ink-Jet Head 101>

Figure 9:
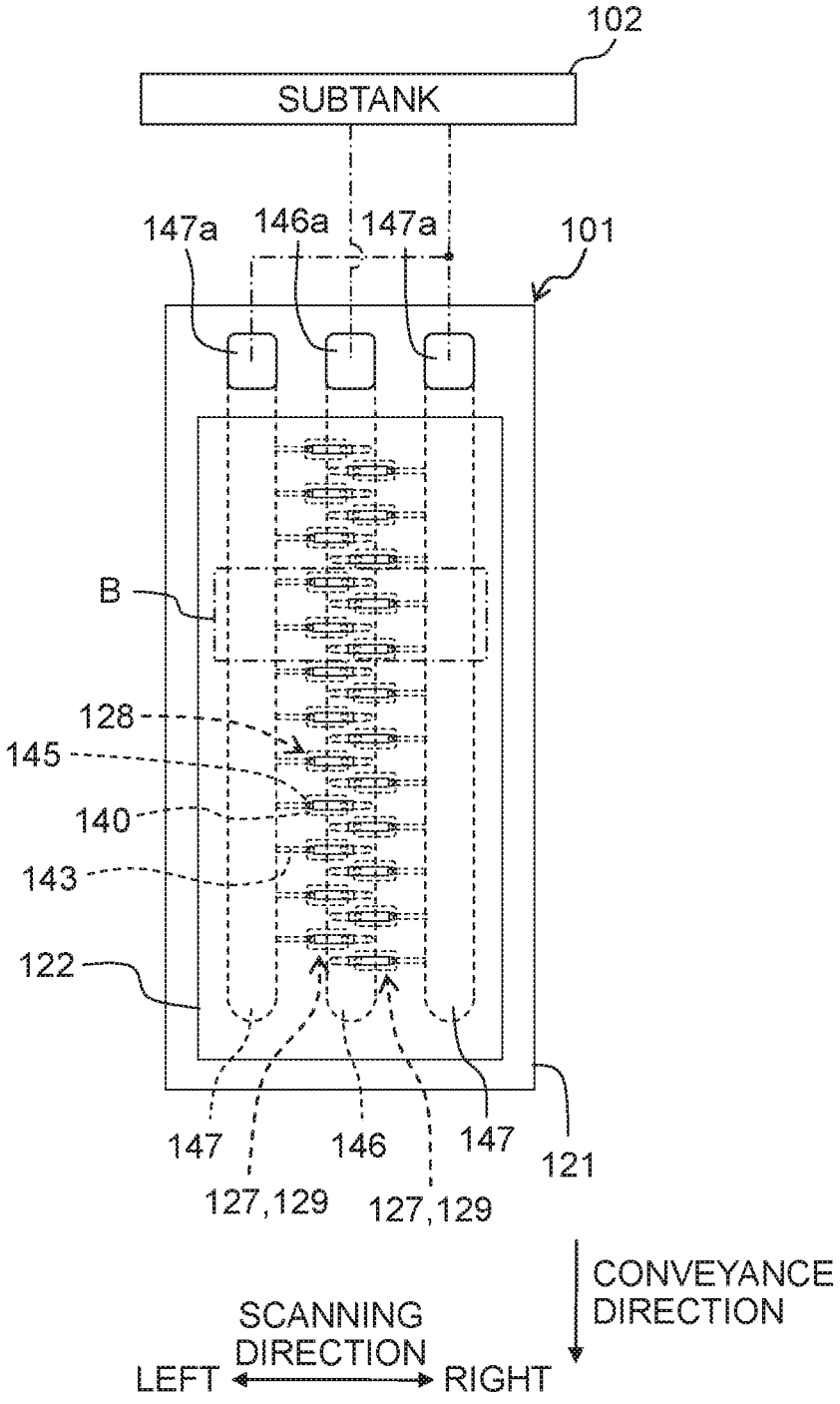
FIG. 9 is a plan view of an ink-jet head 101 according to a second embodiment.
Figure 10:
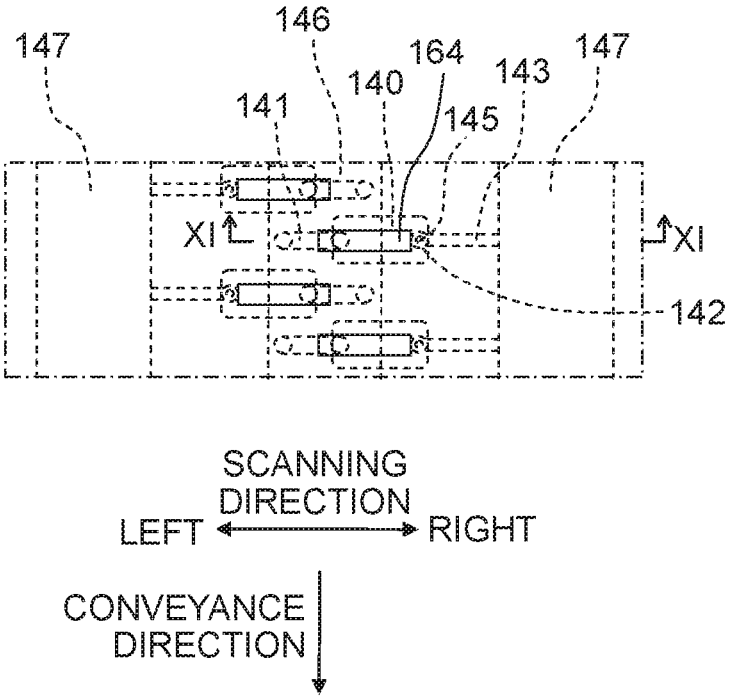
FIG. 10 is an enlarged view of a section B of FIG. 9.
Figure 11:
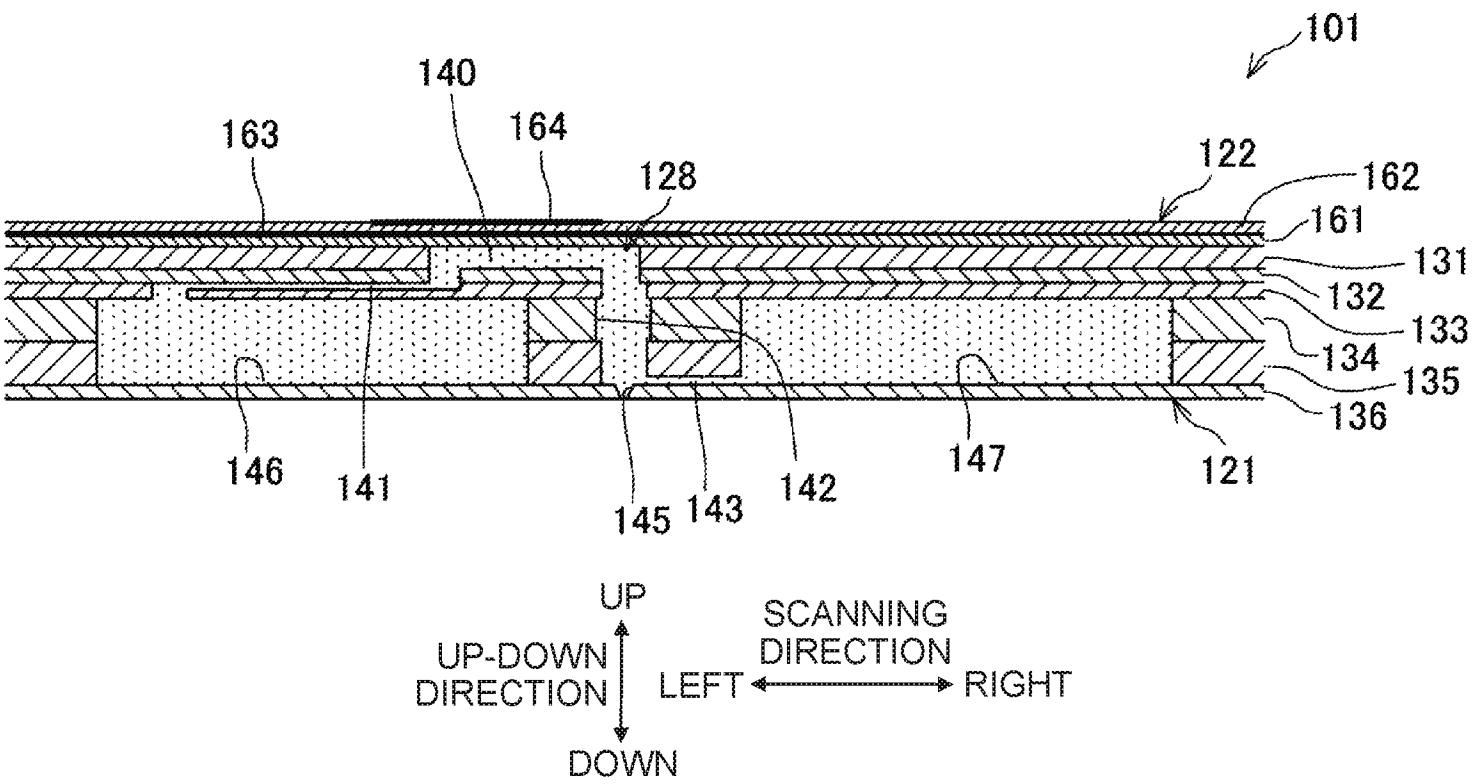
FIG. 11 is a cross-sectional view taken along a line XI-XI in FIG. 10.

As depicted in FIGS. 9 to 11, the ink-jet head 101 includes a channel unit 121 and a piezoelectric actuator 122.

<Channel Unit 121>

The channel unit 121 is formed by stacking six plates 131 to 136 in that order starting from the upper side in the up-down direction, as depicted in FIG. 11. The channel unit 121 includes pressure chambers 140, throttling channels 141, descender channels 142, connection channels 143, nozzles 145, a first manifold 146, and two pieces of second manifold 147.

The pressure chambers 140 are formed in the plate 131. The pressure chambers 140 are the same as the pressure chambers 40. The pressure chambers 140 arrayed in the conveyance direction form a pressure chamber row 129. The plate 131 has two pressure chamber rows 129 arranged in the scanning direction. The pressure chambers 140 belonging to one of the two adjacent pressure chamber rows 129 are positioned to be shifted or deviated, in the conveyance direction, from the pressure chambers 140 belonging to the other of the two adjacent pressure chamber rows 129.

The throttling channels 141 extend over the plates 132 and 133. Each of the throttling channels 141 is provided corresponding to one of the pressure chambers 140. The throttling channels 141 corresponding to the pressure chamber row 129 disposed on the left side in the scanning direction are connected to right ends in the scanning direction of the pressure chambers 140 so that the throttling channels 141 extend rightward in the scanning direction from the connection portions with the pressure chambers 140. The throttling channels 141 corresponding to the pressure chamber row 129 disposed on the right side in the scanning direction are connected to left ends in the scanning direction of the pressure chambers 40 so that the throttling channels 141 extend leftward in the scanning direction from the connection portions with the pressure chambers 140.

The descender channels 142 are formed by a through hole in the plates 132 to 135 that overlap with each other in the up-down direction. Each of the descender channels 142 is provided corresponding to one of the pressure chambers 140. The descender channel 142 is connected to an end, of the corresponding pressure chamber 140, on the opposite side of the throttling channel 141 in the scanning direction so that the descender channel 142 extends downward from the connection portion with the pressure chamber 140.

The communicating channels 143 are formed in the plate 135. Each of the communicating channels 143 is provided corresponding to one of the descender channels 142. The communicating channels 143 corresponding to the pressure chamber row 129 disposed on the left-side in the scanning direction are connected to left ends in the scanning direction of lower ends of the descender channels 142 so that the communicating channels 143 extend leftward in the scanning direction from the connection portions with the descender channels 142. The communicating channels 143 corresponding to the pressure chamber row 129 disposed on the right-side in the scanning direction are connected to right ends in the scanning direction of the lower ends of the descender channels 142 so that the communicating channels 143 extend rightward in the scanning direction from the connection portions with the descender channel 142.

The nozzles 145 are formed in the plate 136. Each of the nozzles 145 is provided corresponding to one of the descender channels 142 to overlap therewith in the up-down direction.

The channel unit 121 includes individual channels 128 each including: one of the nozzles 145; one of the descender channels 142 connected to that nozzle 145; one of the pressure chambers 140 connected to that descender channel 142; one of the throttling channels 141 connected to that pressure chamber 140; and one of the communicating channels 143 connected to that descender channel 142. The individual channels 128 form an individual channel row 127 arrayed in the conveyance direction. The channel unit 121 includes two individual channel rows 127 arranged in the scanning direction.

The first manifold 146 is formed by a through hole in the plates 134 and 135 that overlap with each other in the up-down direction. The first manifold 146 extends in the conveyance direction and positioned, in the scanning direction, between the nozzles 145 forming one of the two individual channel rows 127 and the nozzles 145 forming the other individual channel row 127. The first manifold 146 is connected to ends of the throttling channels 141 on the opposite side of the pressure chambers 140.

An upstream end in the conveyance direction of the first manifold 146 extends over the plates 131 to 135 in the up-down direction, and a connection port 146*a* is provided in an upper end of the first manifold 146. The connection port 146*a* is connected to the subtank 102.

The two second manifolds 147 are formed by a through hole in the plates 134 and 135 that overlap with each other in the up-down direction. The two second manifolds 147 extend in the conveyance direction and arranged to sandwich the two individual channel rows 127 in the scanning direction. The two second manifolds 147 correspond to the two individual channel rows 127, respectively. Each of the second manifolds 147 is connected to ends, of the communicating channels 143 of the individual channels 128 forming the corresponding one of the individual channel rows 127, on the opposite side of the descender channels 142.

An upstream end in the conveyance direction of each second manifold 147 extends over the plates 131 to 135 in the up-down direction, and a connection port 147*a* is provided at an upper end of the second manifold 147. The connection ports 147*a* of the two second manifolds 147 are connected to each other and then connected to the subtank 102.

In the second embodiment, a portion of the individual channel 128 that is formed by the descender channel 142, the pressure chamber 140, and the throttling channel 141 to cause the nozzle 145 to communicate with the first manifold 146 corresponds to a first communicating portion of the present disclosure. A portion of the individual channel 128 that is formed by the communicating channel 143 to cause the nozzle 145 to communicate with the second manifold 147 corresponds to a second communicating portion of the present disclosure.

<Piezoelectric Actuator 122>

The piezoelectric actuator 122 includes two piezoelectric layers 161 and 162, a common electrode 163, and individual electrodes 164. The piezoelectric layers 161 and 162 are made by using a piezoelectric material. The piezoelectric layer 161 is disposed on an upper surface of the channel unit 121. The piezoelectric layer 162 is disposed on an upper surface of the piezoelectric layer 161.

The common electrode 163 is disposed between the piezoelectric layer 161 and the piezoelectric layer 162. The common electrode 163 continuously extends over almost the entire area of the piezoelectric layers 161 and 162. Each of the individual electrodes 164 is provided corresponding to one of the pressure chambers 140. The individual electrode 164 has a substantially rectangular planar shape of which longitudinal direction is the conveyance direction. Each of the individual electrodes 164 is disposed to overlap with the center of the corresponding one of the pressure chambers 140 in the up-down direction.

<Subtank 102>

Figure 12A:
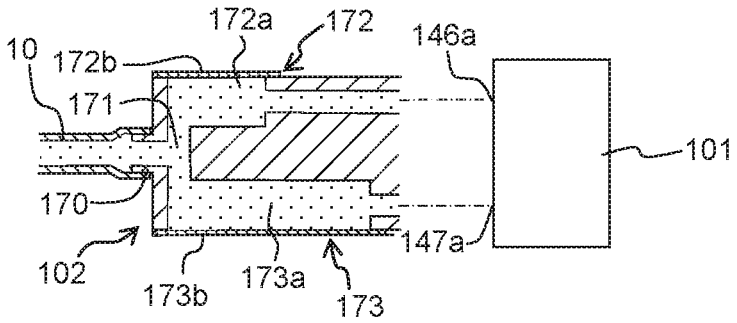
FIG. 12A is a cross-sectional view of a portion including dampers 172 and 173 of a subtank 102 along the scanning direction.

As depicted in FIG. 12A, the subtank 102 includes a tube connection portion 170, a branched channel 171, a first damper 172, a second damper 173, and the like. Similar to the tube connection portion 70 (see FIG. 5A), the tube connection portion 170 is a portion connected to the tube 10. Similar to the branched channel 71 (see FIG. 5A), the branched channel 171 branches at the tube connection portion 170 to extend in the up-down direction.

The first damper 172 includes a first damper chamber 172*a* and a first damper film 172*b*. The length in the scanning direction of the first damper chamber 172*a* is shorter (the volume of the first damper chamber 172*a* is smaller) than that of the first damper chamber 72*a* (see FIG. 5A). The first damper chamber 172*a* is connected to the connection port 146*a* via an ink channel (not depicted) formed in the subtank 102. The first damper film 172*b* functions as an upper wall of the first damper chamber 172*a*. The length in the scanning direction of the first damper film 172*b* is shorter (the area of the first damper film 172*b* is smaller) than that of the first damper film 72*b* (see FIG. 5A).

The second damper 173 includes a second damper chamber 173*a* and a second damper film 173*b*. Similar to the second damper chamber 73*a* (see FIG. 5A), the second damper chamber 173*a* is connected to the connection port 147*a* via an ink channel (not depicted) formed in the subtank 102. Similar to the second damper film 73*b* (see FIG. 5A), the second damper film 173*b* functions as a lower wall of the second damper chamber 173*a*.

Unlike the first embodiment, the subtank 102 in the second embodiment has no protrusions corresponding to the protrusions 75 and 76. Thus, compliance of the first damper 172 when positive pressure is generated in the first damper chamber 172*a* is substantially the same as compliance of the first damper 172 when negative pressure is generated in the first damper chamber 172*a*. Similarly, compliance of the second damper 173 when positive pressure is generated in the second damper chamber 173*a* is substantially the same as compliance of the second damper 173 when negative pressure is generated in the second damper chamber 173*a*.

In the second embodiment, the first damper chamber 172*a* is smaller in volume than the second damper chamber 173*a*. Further, the first damper film 172*b* is smaller in area than the second damper film 173*b*. The first damper 172 is thus smaller in compliance than the second damper 173, and this magnitude relation between compliance of the first damper 172 and compliance of the second damper 173 is not affected by whether positive pressure or negative pressure is generated in the damper chambers 172*a* and 173*a*. For example, compliance of the second damper 173 is approximately 1.5 to 3 times of compliance of the first damper 172. When the ratio of compliance of the second damper 173 to compliance of the first damper 172 is set to this range, the second damper 173 can be prevented from having a very large size. This can prevent a shortage of ink supply which may otherwise caused when the amount of ink to be supplied to the ink-jet head 4 is large and when ink is supplied from both the connection ports 46*a* and 47*a* to the ink-jet head 4.

<Control by Controller 50>

Similar to the first embodiment, the controller 50 performs pieces of processing in accordance with flowcharts of FIGS. 7 and 8 in the second embodiment. In the second embodiment, as indicated in FIG. 13, the moving velocity of the carriage 2 when moving leftward in the scanning direction (e.g., the first non-discharge scan processing in S104 and the discharge scan processing in S202) is defined as a moving velocity V1. The moving velocity of the carriage 2 when moving rightward in the scanning direction (e.g., the second non-discharge scan processing in S105, S205) is defined as a moving velocity V2 faster than the moving velocity V1. For example, the moving velocity V1 is set to approximately 30 [inch/sec], and the moving velocity V2 is set to approximately 45 to 60 [inch/sec]. The moving velocity V2 is set to be approximately 1.5 to 2 times of the moving velocity V1.

When the controller 50 performs pieces of processing in accordance with the flowcharts of FIGS. 7 and 8, ink is discharged from nozzles 45 during leftward movement in the scanning direction of the carriage 2 in the discharge scan processing (S202). In order that ink lands in appropriate positions, the moving velocity of the carriage 2 moving leftward in the scanning direction is not allowed to be so fast. Meanwhile, no ink is discharged from nozzles 45 during rightward movement in the scanning direction of the carriage 2, and thus the moving velocity of the carriage 2 moving rightward in the scanning direction is allowed to be fast. Thus, in the second embodiment, the moving velocity V2 of the carriage 2 moving rightward in the scanning direction is faster than the moving velocity V1 of the carriage 2 moving leftward in the scanning direction.

Figure 12B:
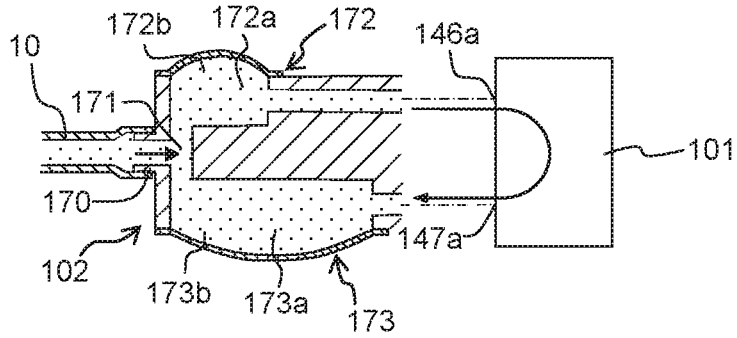
FIG. 12B depicts a state in which the carriage 2 is positioned on the left side in the scanning direction and FIG. 12B corresponds to FIG. 12A.

Similar to the first embodiment, when the carriage 2 moves leftward in the scanning direction, positive pressure is generated in the damper chambers 172*a* and 173*a* and the damper films 172*b* and 173*b* are deformed to be convex toward the outside of the damper chambers 172*a* and 173*a*, as depicted in FIG. 12B. Here, as described above, the first damper 172 is smaller in compliance than the second damper 173. This makes positive pressure in the first damper chamber 172*a* greater than positive pressure in the second damper chamber 173*a*. The difference in positive pressure between the first damper chamber 172*a* and the second damper chamber 173*a* generates ink flow from the first damper chamber 172*a* to the second damper chamber 173*a* via ink channels (the first manifold 143, the individual channels 128, and the second manifold 147) of the ink-jet head 101.

Figure 12C:
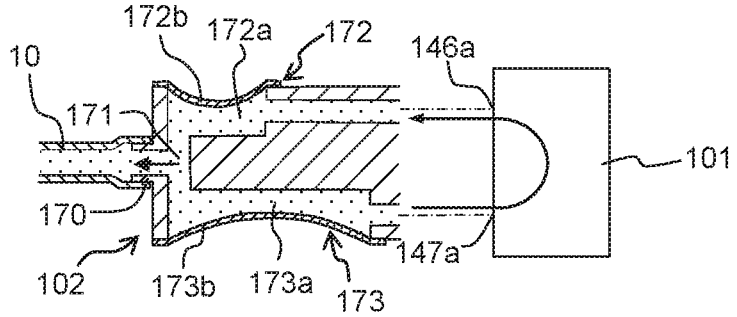
FIG. 12C depicts a state in which the carriage 2 is positioned on the right side in the scanning direction and FIG. 12C corresponds to FIG. 12A.
Figure 12C:
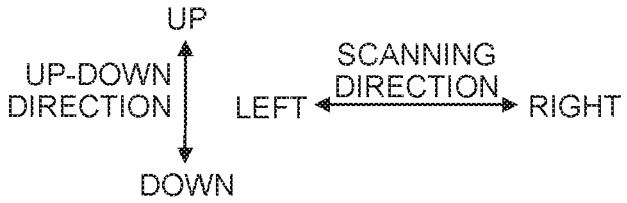

Similar to the first embodiment, when the carriage 2 moves rightward in the scanning direction, negative pressure is generated in the damper chambers 172*a* and 173*a* and the damper films 172*b* and 173*b* are deformed to be convex toward the inside of the damper chambers 172*a* and 173*a*, as depicted in FIG. 12C. Here, as described above, the first damper 172 is smaller in compliance than the second damper 173. This makes negative pressure in the first damper chamber 172*a* greater than negative pressure in the second damper chamber 173*a*. The difference in negative pressure between the first damper chamber 172*a* and the second damper chamber 173*a* generates ink flow from the second damper chamber 173*a* to the first damper chamber 172*a* via ink channels of the ink-jet head 101.

In the second embodiment, as described above, the ink flow direction in the ink-jet head 101 when the carriage 2 moves leftward is opposite to that when the carriage 2 moves rightward. In the second embodiment, however, the moving velocity V2 when the carriage 2 moves rightward is faster than the moving velocity V1 when the carriage 2 moves leftward. Further, the pressure change in the damper chambers 172*a* and 173*a* generated by movement of the carriage 2 is greater, as the moving velocity of the carriage 2 is faster. Thus, the pressure difference between the first damper chamber 172*a* and the second damper chamber 173*a* is greater, as the moving velocity of the carriage 2 is faster.

In that configuration, the amount of ink that flows through the ink-jet head 101 per unit time from the connection port 147*a* to the connection port 146*a* when the carriage 2 moves rightward at the moving velocity V2, is larger than the amount of ink that flows through the ink-jet head 101 per unit time from the connection port 146*a* to the connection port 147*a* when the carriage 2 moves leftward at the moving velocity V1. Thus, when the carriage 2 repeats reciprocating movement in the scanning direction, ink in the ink-jet head 101 gradually moves from the connection port 147*a* to the connection port 146*a*.

<Third Embodiment>

Figure 14:
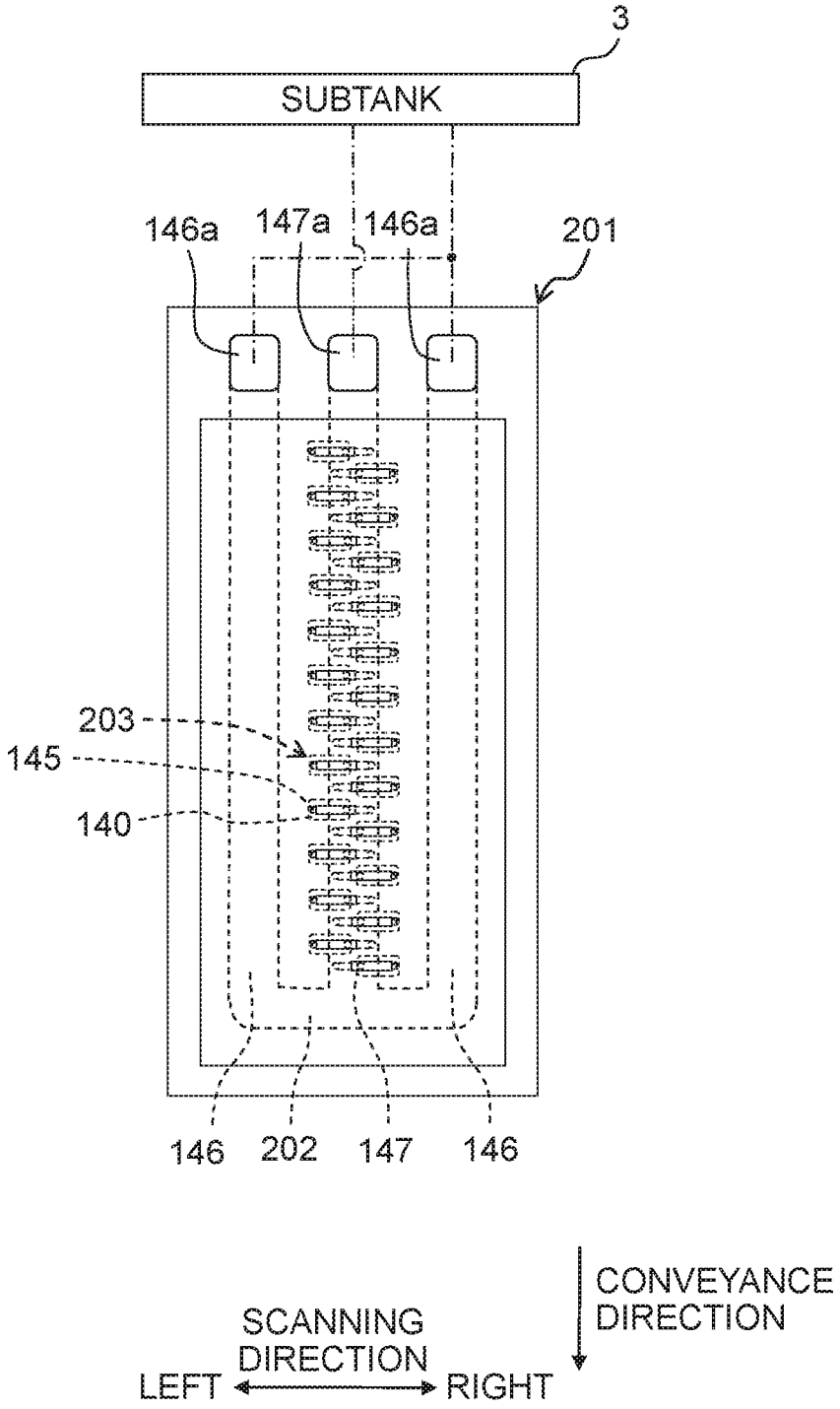
FIG. 14 is a plan view of an ink-jet head 201 according to a third embodiment.

Subsequently, a third embodiment of the present disclosure is explained. A printer according to the third embodiment includes an ink-jet head 201 instead of the ink-jet head 4 of the printer 1 according to the first embodiment. As depicted in FIG. 14, the communicating channels 143 of the ink-jet head 101 are not included in the ink-jet head 201. Downstream ends in the conveyance direction of the first manifolds 146 and a downstream end in the conveyance direction of the second manifold 147 are connected to each other by using a bypass channel 202 extending in the scanning direction. Namely, in the third embodiment, the first manifolds 146 are not connected to the second manifold 147 via the individual channels 203.

In the third embodiment, when the difference in positive pressure between the first damper chamber 172*a* and the second damper chamber 173*a* of the subtank 3 is generated and when the difference in negative pressure between the first damper chamber 172*a* and the second damper chamber 173*a* of the subtank 3 is generated, ink flows from the connection port 146*a* to the connection port 147*a* via the first manifold 146, the bypass channel 202, and the second manifold 147.

In the third embodiment, the explanation is made assuming that the subtank of the third embodiment is the subtank 3 of the first embodiment. In the third embodiment, however, the subtank 102 of the second embodiment may be used to make the moving velocity V2 when the carriage 2 moves rightward faster than the moving velocity V1 when the carriage 2 moves leftward.

<Fourth Embodiment>

Figure 15:
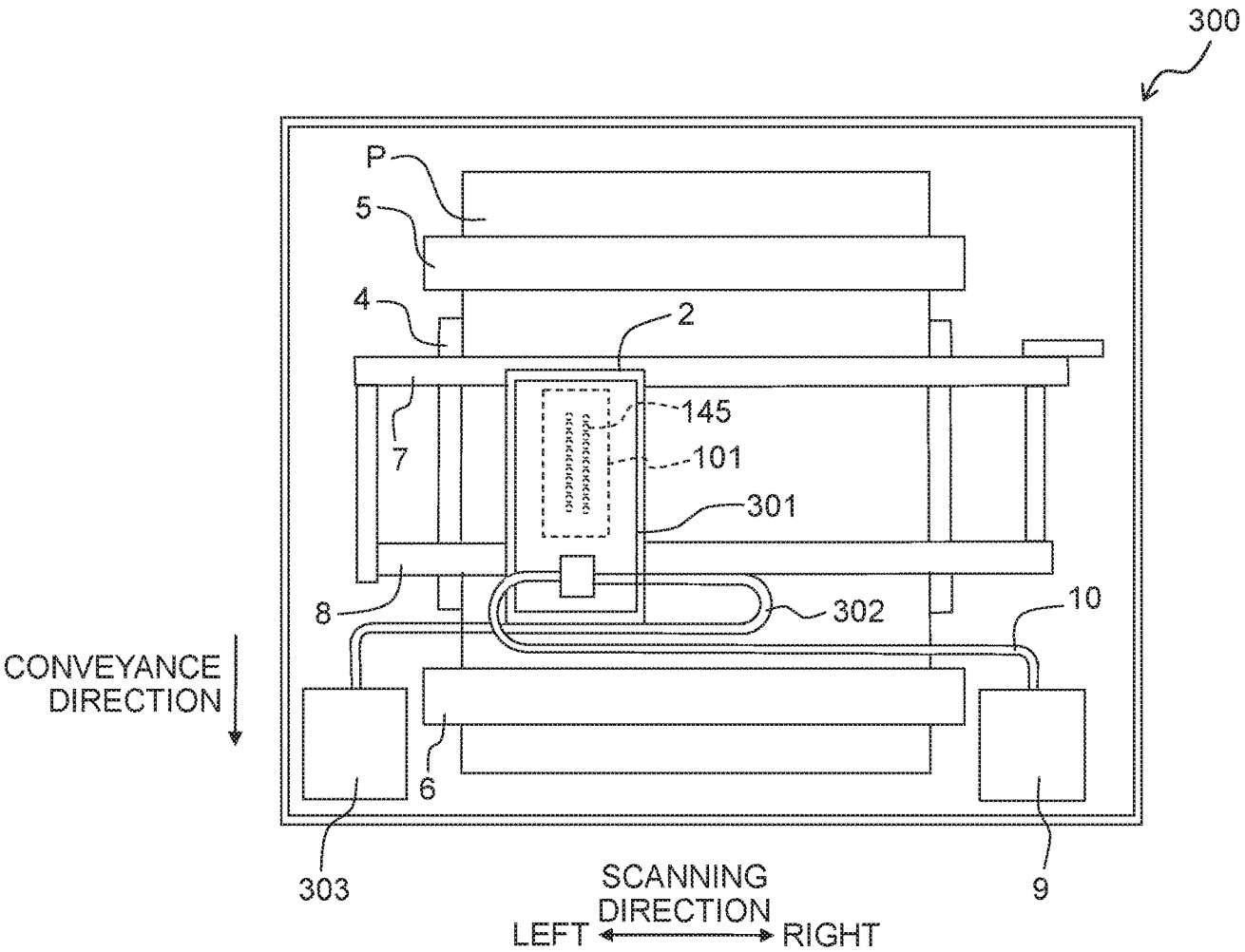
FIG. 15 depicts a schematic configuration of a printer 300 according to a fourth embodiment.

Subsequently, a fourth embodiment of the present disclosure is explained. As depicted in FIG. 15, a printer 300 according to the fourth embodiment includes the ink-jet head 101 that is the same as the second embodiment and a subtank 301, instead of the ink-jet head 4 and the subtank 3 of the printer 1 according to the first embodiment. In the printer 300, the subtank 301 is connected to the ink tank 9 (a first tank of the present disclosure) via the tube 10 (a first tube of the present disclosure), and the subtank 301 is connected to an ink tank 303 (a second tank of the present disclosure), which is different from the ink tank 9, via a tube 302 (a second tube of the present disclosure).

Figure 16A:
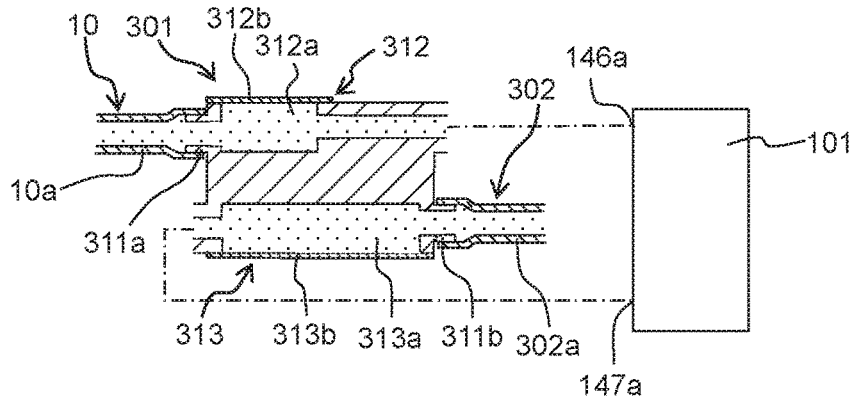
FIG. 16A is a cross-sectional view of a portion including dampers 312 and 313 of a subtank 301 along the scanning direction.

As depicted in FIG. 16A, the subtank 301 includes tube connection portions 311*a* and 311*b*, a first damper 312, a second damper 313, and the like. The tube connection portion 311*a* is directed leftward in the scanning direction and the tube 10 is connected to the tube connection portion 311*a* from the left side in the scanning direction. In that configuration, the tube 10 has a portion 10*a* (a first channel portion of the present disclosure) extending leftward in the scanning direction from the connection portion with the tube connection portion 311*a*.

The tube connection portion 311*b* is directed rightward in the scanning direction, and the tube 302 is connected to the tube connection portion 311*b* from the right side in the scanning direction. In that configuration, the tube 302 has a portion 302*a* (a second channel portion of the present disclosure) extending rightward in the scanning direction from the tube connection portion 311*b*.

The first damper 312, which is disposed on the right side of the tube connection portion 311*a*, includes a first damper chamber 312*a* and a first damper film 312*b*. The first damper chamber 312*a* is a space similar to the first damper chamber 172*a* (see FIG. 12A). The first damper chamber 312*a* is connected to the tube connection portion 311*a*. The first damper chamber 312*a* is connected to the connection port 146*a* of the ink-jet head 101 via an ink channel (not depicted) formed in the subtank 301. The first damper film 312*b* is a film similar to the first damper film 172*b* (see FIG. 12A).

The second damper 313, which is disposed on the left side of the tube connection portion 311*b*, includes a second damper chamber 313*a* and a second damper film 313*b*. The second damper chamber 313*a* is a space similar to the second damper chamber 173*a* (see FIG. 12A). The second damper chamber 313*a* is connected to the tube connection portion 311*b*. The second damper chamber 313*a* is connected to the connection port 147*a* of the ink-jet head 101 via an ink channel (not depicted) formed in the subtank 301. The second damper film 313*b* is a film similar to the second damper film 173*b* (see FIG. 12A).

In the fourth embodiment, the first damper chamber 312*a* is smaller in volume than the second damper chamber 313*a*, and the first damper film 312*b* is smaller in area than the second damper film 313*b*. The first damper 312 is thus smaller in compliance than the second damper 313.

In the fourth embodiment, a ratio of channel resistance in the first communicating portion formed by the descender channel 142, the pressure chamber 140, and the throttling channel 141 included in the individual channel 128 of the ink-jet head 101, to channel resistance of the second communicating portion formed by the communicating channel 143 included in the individual channel 128 of the ink-jet head 101 is R1:R2. A ratio of compliance of the first damper 312 to compliance of the second damper 313 is R2:R1.

Figure 16B:
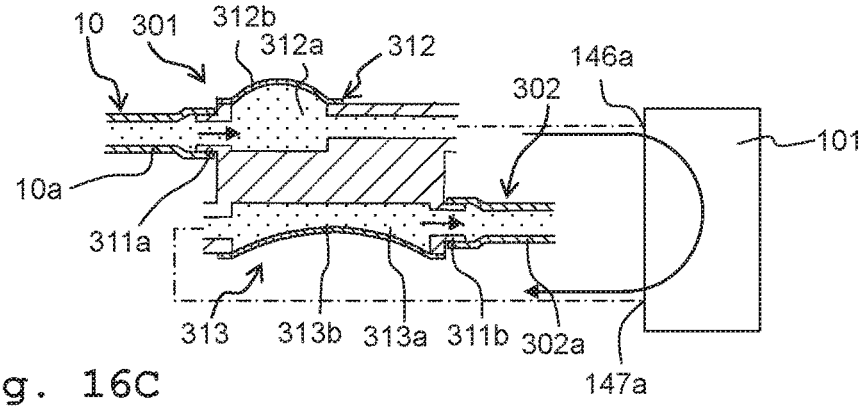
FIG. 16B depicts a state in which the carriage 2 is positioned on the left side in the scanning direction and FIG. 16B corresponds to FIG. 16A.

In the fourth embodiment, when the carriage 2 moves leftward in the scanning direction in the first non-discharge scan processing (S104) and the discharge scan processing (S202), ink in the portion 10*a* of the tube 10 flows into the first damper chamber 312*a* to generate positive pressure in the first damper chamber 312*a*, as depicted in FIG. 16B. Ink in the second damper chamber 313*a* flows into the portion 302*a* of the tube 302 to generate negative pressure in the second damper chamber 313*a*. The difference between positive pressure in the first damper chamber 312*a* and negative pressure in the second damper chamber 313*a* causes ink in the ink-jet head 4 to flow from the connection port 146*a* to the connection port 147*a*.

Figure 16C:
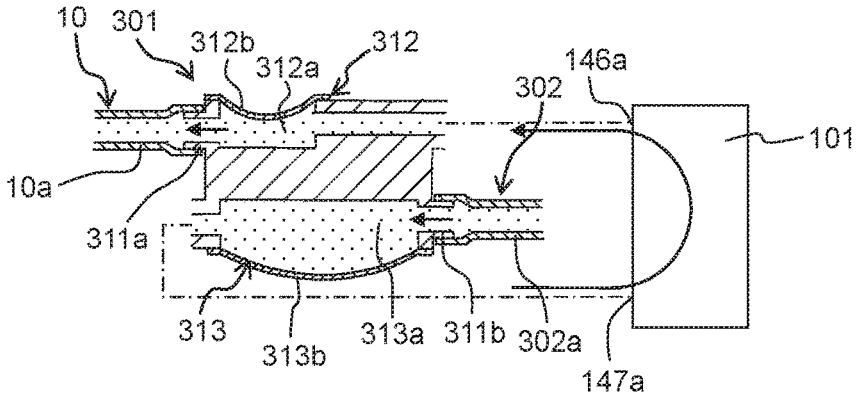
FIG. 16C depicts a state in which the carriage 2 is positioned on the right side in the scanning direction and FIG. 16C corresponds to FIG. 16A.
Figure 16C:
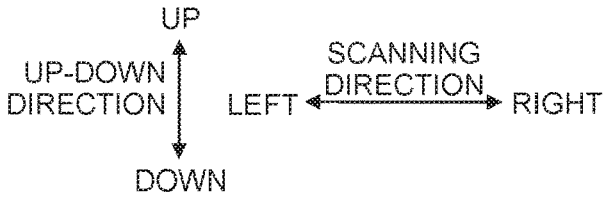

When the carriage 2 moves rightward in the scanning direction in the second non-discharge scan processing (S105, S205), ink in the first damper chamber 312*a* flows into the portion 10*a* of the tube 10 to generate negative pressure in the first damper chamber 312*a*, as depicted in FIG. 16C. Ink in the portion 302*a* of the tube 302 flows into the second damper chamber 313*a* to generate positive pressure in the second damper chamber 313*a*. The difference between negative pressure in the first damper chamber 312*a* and positive pressure in the second damper chamber 313*a* causes ink in the ink-jet head 4 to flow from the connection port 147*a* to the connection port 146*a*.

In the fourth embodiment, when the carriage 2 moves in the scanning direction, positive pressure is generated in one of the first damper chamber 312*a* and the second damper chamber 313*a*, and negative pressure is generated in the other of the first damper chamber 312*a* and the second damper chamber 313*a*. In that configuration, the pressure difference between the first damper chamber 312*a* and the second damper chamber 313*a* is greater than a configuration in which positive pressure or negative pressure is generated both in the damper chambers 312*a* and 313*a*. This efficiently generates ink flow in the ink-jet head 101.

In the fourth embodiment, the moving velocity when the carriage 2 moves leftward in the scanning direction is equal to the moving velocity when the carriage 2 moves rightward in the scanning direction. As described above, in the fourth embodiment, compliance of the first damper 312 when positive pressure is generated in the first damper chamber 312*a* is equal to compliance of the first damper 312 when negative pressure is generated in the first damper chamber 312*a*. Further, compliance of the second damper 313 when positive pressure is generated in the second damper chamber 313*a* is equal to compliance of the second damper 313 when negative pressure is generated in the second damper chamber 313*a*. In that configuration, the amount of ink flowing from the connection portion 146*a* to the connection port 147*a* when the carriage 2 moves leftward in the scanning direction, is the substantially the same as the amount of ink flowing from the connection portion 147*a* to the connection port 146*a* when the carriage 2 moves rightward in the scanning direction. Thus, when the carriage 2 repeats reciprocating movement in the scanning direction, ink does not gradually flow in one direction. This prevents a situation in which the amount of ink in one of the ink tank 9 and ink tank 302 increases and the amount of ink in the other of ink tank 9 and ink tank 302 decreases.

In the fourth embodiment, the tube 10 extends leftward in the scanning direction from the tube connection portion 311*a*, and the tube 302 extends rightward in the scanning direction from the tube connection portion 311*b*. Namely, the tube 10 extends from an end on the ink-jet head 101 side toward a first side in the scanning direction, and the tube 302 extends from an end on the ink-jet head 101 side toward a second side in the scanning direction. The first side is opposite to the second side in the scanning direction. Since the ink tank 9 connected to the tube 10 is provided separately from the ink tank 303 connected to the tube 302 in the fourth embodiment, routing or placement of the tubes 10 and 302 can be simplified compared to a configuration in which an ink tank is singly provided.

In the fourth embodiment, compliance of the dampers 312 and 313 when positive pressure is generated in the damper chambers 312*a* and 313*a* may be different from compliance of the dampers 312 and 313 when negative pressure is generated in the damper chambers 312*a* and 313*a*. For example, protrusions similar to the protrusions 75 and 76 in the first embodiment may be provided to regulate deformation of the damper films 312*b* and 313*b*. In that case, similar to the first embodiment, reciprocating movement in the scanning direction of the carriage 2 can generate ink flow in one direction from the connection port 146*a* to the connection port 147*a*. This causes ink to flow from the ink tank 9 to the ink tank 303.

In the fourth embodiment, the moving velocity when the carriage 2 moves leftward may be different from the moving velocity when the carriage 2 moves rightward. For example, like the second embodiment, the moving velocity V2 when the carriage 2 moves rightward may be faster than the moving velocity V1 when the carriage 2 moves leftward, in the fourth embodiment. In that case, ink in the ink-jet head 4 gradually moves from the connection port 147*a* to the connection port 146*a*, and ink flows from the ink tank 302 to the ink tank 9.

In the fourth embodiment, when ink in the ink-jet head 101 flows, the pressure in the ink channels in the ink-jet head 101 becomes a pressure between positive pressure generated in one of the damper chambers 312*a* and 313*a* and negative pressure generated in the other of the damper chambers 312*a* and 313*a*, and gradually decreases from the damper chamber side on which positive pressure is generated to the damper chamber side on which negative pressure is generated. In that situation, any portion of the ink channels in the ink-jet head 101 has a pressure of substantially zero. In the fourth embodiment, a ratio of the channel resistance of the first channel portion of the individual channel 128 to the channel resistance of the second channel portion of the individual channel 128 is R1:R2 (e.g., approximately 1:0.7 to 3), and a ratio of the compliance of the first damper 312 to the compliance of the second damper 313 is R2:R1 (e.g., approximately 0.7 to 3:1). Thus, the nozzles 45 constantly have a pressure of substantially zero when ink circulates through the ink-jet head 101. Accordingly, the pressure of ink in the nozzles 45 is prevented from changing greatly, thereby preventing destruction or break of meniscus of ink in each nozzle 45.

Although the first to fourth embodiments of the present disclosure are explained above, the present disclosure is not limited to the first to fourth embodiments. Various modifications can be applied to those embodiments within the appended claims.

In the first embodiment, the protrusion 75 that regulates outward deformation of the first damper film 72*b* relative to the first damper chamber 72*a* makes compliance of the first damper 72 when positive pressure is generated in the first damper chamber 72*a* smaller than compliance of the first damper 72 when negative pressure is generated in the first damper chamber 72*a*. Further, the protrusion 76 that regulates inward deformation of the second damper film 73*b* relative to the second damper chamber 73*a* makes compliance of the second damper 73 when positive pressure is generated in the second damper chamber 73*a* greater than compliance of the second damper 73 when negative pressure is generated in the second damper chamber 73*a*. The present disclosure, however, is not limited thereto.

For example, a first regulating portion that is different in configuration from the protrusion 75 and regulates outward deformation of the first damper film 72*b* relative to the first damper chamber 72*a* may be provided. Further, a second regulating portion that is different in configuration from the protrusion 76 and regulates inward deformation of the second damper film 73*b* relative to the second damper chamber 73*a* may be provided.

Figure 17A:
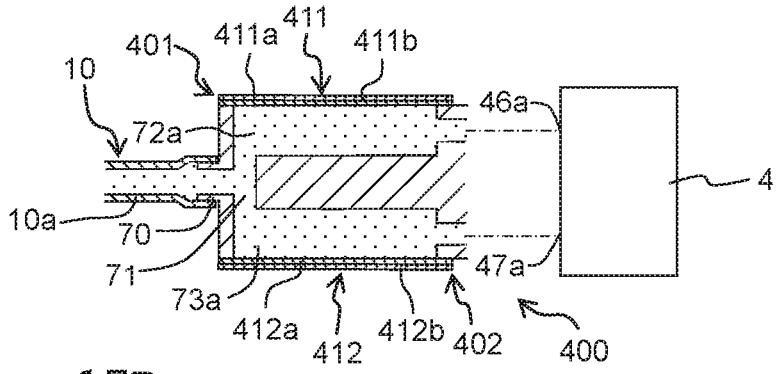
FIG. 17A is a cross-sectional view, along the scanning direction, of a portion including dampers 401 and 402 of a subtank 400 according to a modified example.
Figure 17B:
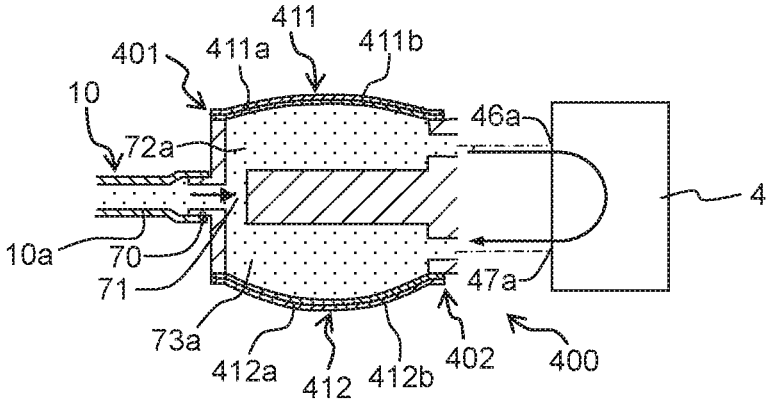
FIG. 17B depicts a state in which the carriage 2 is positioned on the left side in the scanning direction and FIG. 17B corresponds to FIG. 17A.
Figure 17C:
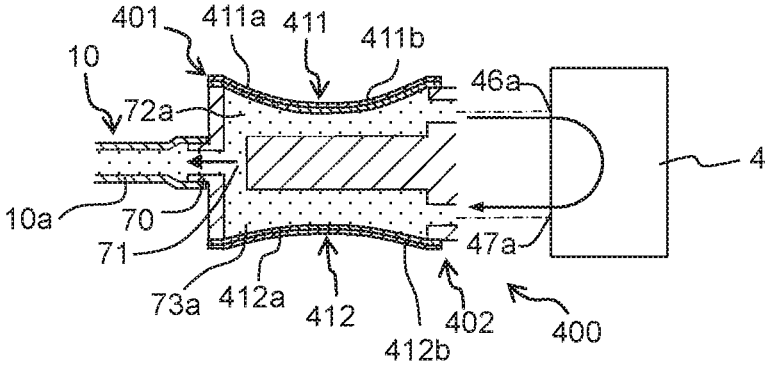
FIG. 17C depicts a state in which the carriage 2 is positioned on the right side in the scanning direction and FIG. 17C corresponds to FIG. 17A.
Figure 17C:
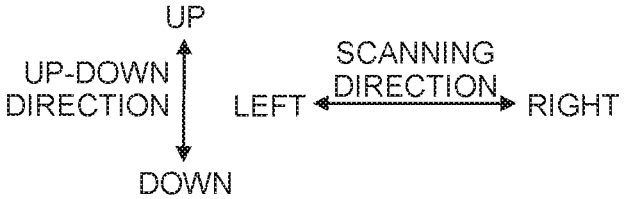

The present disclosure is not limited to the configuration in which the regulating portions regulate deformation of the damper films 72*b* and 73*b*. In one modified example, as depicted in FIG. 17A, a first damper 401 of a subtank 400 includes a first damper film 411 instead of the first damper film 72*b* of the first damper 72 (see FIG. 5A) according to the first embodiment. Further, a second damper 402 of the subtank 400 includes a second damper film 412 instead of the second damper film 73*b* of the second damper 73 (see FIG. 5A) according to the first embodiment.

The first damper film 411 is a two-layered film having an inner film 411*a* and an outer film 411*b* disposed on an upper surface of the inner film 411*a*. The outer film 411*b* is higher in rigidity than the inner film 411*a*. The second damper film 412 is a two-layered film having an inner film 412*a* and an outer film 412*b* disposed on a lower surface of the inner film 412*a*. The outer film 412*b* is lower in rigidity than the inner film 412*a*.

When the damper films 411 and 412 are deformed to be convex outward of the damper chambers, outer portions of the damper films 411 and 412 have a larger deformation amount. When the damper films 411 and 412 are deformed to be convex inward of the damper chambers, inner portions of the damper films 411 and 412 have a larger deformation amount.

In the first damper film 411, the outer film 411*b* disposed on the upper side of the inner film 411*a* is higher in rigidity than the inner film 411*a*, and thus the outer film 411*b* is not likely to be deformed. In that configuration, when the first damper film 411 is deformed to be convex upward (the outside of the first damper chamber 72*a*), the deformation amount thereof is smaller than a case in which the first damper film 411 is deformed to be convex downward (the inside of the first damper chamber 72*a*). This makes compliance of the first damper 401 when positive pressure is generated in the first damper chamber 72*a* smaller than compliance of the first damper 401 when negative pressure is generated in the first damper chamber 72*a*.

In the second damper film 412, the inner film 412*a* disposed on the upper side of the outer film 412*b* is higher in rigidity than the outer film 412*b*, and thus the inner film 412*a* is not likely to be deformed. In that configuration, when the second damper film 412 is deformed to be convex upward (the inside of the second damper chamber 73*a*), the deformation amount thereof is smaller than a case in which the second damper film 412 is deformed to be convex downward (the outside of the second damper chamber 73*a*). This makes compliance of the second damper 402 when positive pressure is generated in the second damper chamber 73*a* greater than compliance of the second damper 402 when negative pressure is generated in the second damper chamber 73*a*.

Compliance of one of the first damper and the second damper when positive pressure is generated in the damper chamber corresponding to the one damper may be different from compliance of one of the first damper and the second damper when negative pressure is generated in the damper chamber corresponding to the one damper, and compliance of the other of the first damper and the second damper when positive pressure is generated in the damper chamber corresponding to the other damper may be the same as compliance of the other of the first damper and the second damper when negative pressure is generated in the damper chamber corresponding to the other damper. For example, in the first embodiment, only one of the protrusions 75 and 76 may be provided. Also in that case, the magnitude relation between compliance of the first damper and compliance of the second damper when positive pressure is generated in the first and second damper chambers can be opposite to the magnitude relation between compliance of the first damper and compliance of the second damper when negative pressure is generated in the first and second damper chambers.

The magnitude relation between compliance of the first damper 72 and compliance of the second damper 73 when positive pressure is generated in the first and second damper chambers 72*a* and 73*a* and the magnitude relation between compliance of the first damper 72 and compliance of the second damper 73 when negative pressure is generated in the first and second damper chambers 72*a* and 73*a* may be different from those described in the first embodiment. In that case, unlike the first embodiment, ink flows from the second damper chamber 73*a* to the first damper chamber 72*a* via ink channels in the ink-jet head 4 when the carriage 2 moves in the scanning direction.

In the second embodiment, the moving velocity when the carriage 2 moves rightward is faster than the moving velocity when the carriage 2 moves leftward. The present disclosure is not limited thereto. The moving velocity when the carriage moves leftward may be faster than the moving velocity when the carriage 2 moves rightward. In that case, when the carriage 2 repeats reciprocating movement in the scanning direction, ink in the ink-jet head 101 gradually moves from the connection port 146*a* to the connection port 147*a*.

In the second embodiment, the moving velocity of the carriage 2 when the carriage 2 moves leftward may be equal to the moving velocity of the carriage 2 when the carriage 2 moves rightward. In that case, although ink in the ink-jet head 101 does not gradually move from one of the connection ports 146*a* and 147*a* to the other of connection ports 146*a* and 147*a*, ink flows thorough the ink-jet head 101 to reduce the increase in ink viscosity in the nozzles 45.

In the second embodiment, in order to make compliance of the first damper 172 smaller than compliance of the second damper 173, the first damper chamber 172*a* is smaller in volume than the second damper chamber 173*a* and the first damper film 172*b* is smaller in area than the second damper film 173*a*. The present disclosure, however, is not limited thereto.

For example, the first damper chamber and the second damper chamber may have the same volume, the first damper film and the second damper film may have the same area, and the first damper film may be thicker than the second damper film. For example, the first damper film may have a thickness of approximately 80 μm, and the second damper film may have a thickness of approximately 40 μm. The thickness of the first and second damper films may be changed, for example, by making the second damper film one-layer film made using, for example, polypropylene (PP) and making the first damper film a two-layered film made using, for example, polypropylene (PP) and polyethylene terephthalate (PET). Also in that configuration, the first damper can be smaller in compliance than the second damper.

Or, the first damper chamber and the second damper chamber may have the same volume, the first damper film and the second damper film may have the same area, and the first damper film may be higher in rigidity than the second damper film. For example, the first damper film may be made by using rubber, SUS, an aluminum film, or the like which has relatively high rigidity, and the second damper film may be made by using polyimide or a combination of polyethylene terephthalate and polypropylene which has relatively low rigidity. Also in that case, the first damper can be smaller in compliance than the second damper.

In the third embodiment, the first manifold 146 is connected to the second manifolds 147 via the bypass channel 202, and the individual channels 203 do not connect the first manifold 146 and the second manifolds 147. The present disclosure, however, is not limited thereto. For example, an ink-jet head in which the first manifold(s) is/are connected to the second manifold(s) via individual channels, such as the ink-jet head 4 according to the first embodiment and the ink-jet head 101 according to the second embodiment, may include a bypass channel(s) connecting the first manifold(s) and the second manifold(s).

In the fourth embodiment, the ratio of the channel resistance of the first channel portion of the individual channel 128 to the channel resistance of the second channel portion of the individual channel 128 is R1:R2, and the ratio of the compliance of the first damper 312 to the compliance of the second damper 313 is R2:R1. The present disclosure, however, is not limited thereto. The ratio of the channel resistance of the first channel portion of the individual channel 128 to the channel resistance of the second channel portion of the individual channel 128 and the ratio of the compliance of the first damper 312 to the compliance of the second damper 313 may be different from those in the fourth embodiment.

In the fourth embodiment, the tubes 10 and 302 connected to the subtank 301 are respectively connected to the ink tanks 9 and 303. The present disclosure is not limited thereto. For example, the tube 10 and the tube 302 may be connected to the same ink tank if the portion 10*a* of the tube 10 extends leftward in the scanning direction from the connection portion with the tube connection portion 311*a*, and the portion 302*a* of the tube 302 extends rightward in the scanning direction from the connection portion with the tube connection portion 311*b*.

In the first to fourth embodiments, the print processing is so-called unidirectional printing in which ink is discharged from the nozzles 45 during the leftward movement in the scanning direction of the carriage 2 and no ink is discharged from the nozzles 45 during the rightward movement in the scanning direction of the carriage 2. The present disclosure, however, is not limited thereto. The print processing may be so-called bidirectional printing in which ink is discharged from the nozzles 45 during both the leftward movement and the right movement in the scanning direction of the carriage 2.

In the non-discharge scan processing of the first to fourth embodiments, the non-discharge flushing is performed in addition to the rightward movement in the scanning direction of the carriage 2. The present disclosure, however, is not limited thereto. The carriage 2 may move without performing the non-discharge flushing to generate ink flow in the ink-jet head.

In the first to fourth embodiments, the tube has the portion that extends in the scanning direction and moves in the scanning direction together with the carriage. In the first to fourth embodiments, when the carriage 2 moves in the scanning direction, ink in the portion of the tube flows into the damper chamber or ink in the damper chamber flows into the portion of the tube, thereby changing the pressure in the damper chamber. The present disclosure, however, is not limited thereto. For example, an ink channel of the subtank positioned closer to the ink tank than the damper chamber may have a channel portion that extends in the scanning direction and moves in the scanning direction together with the carriage. Also in that case, when the carriage moves in the scanning direction, ink in the channel portion flows into the damper chamber or ink in the damper chamber flows into the channel portion, thereby changing the pressure in the damper chamber. In that case, the channel portion corresponds to a first channel portion and a second channel portion of the present disclosure.

The above explanation is made about an example in which the present disclosure is applied to the printer including the ink-jet head that discharges ink from nozzles. The present disclosure, however, is not limited thereto. The present disclosure can be applied to a liquid discharge apparatus including a liquid discharge head from which any other liquid than ink, such as resin and metal in the form of a liquid, is discharged.

What is claimed is:

1. A liquid discharge apparatus comprising:

a liquid discharge head including at least one nozzle;

a carriage configured to carry the liquid discharge head and configured to move in a scanning direction;

a tank configured to store liquid;

a first connection channel connecting the liquid discharge head and the tank; and a second connection channel connecting the liquid discharge head and the tank and communicating with the first connection channel via the liquid discharge head, wherein the first connection channel includes a first channel portion and a first damper, the first channel portion extending in the scanning direction and configured to move in the scanning direction together with the carriage, the first damper provided closer to the at least one nozzle than the first channel portion and configured to inhibit pressure change in the liquid, wherein the second connection channel includes a second channel portion and a second damper, the second channel portion extending in the scanning direction and configured to move in the scanning direction together with the carriage, the second damper provided closer to the at least one nozzle than the second channel portion and configured to inhibit pressure change in the liquid, and wherein the first damper is different in compliance from the second damper.

2. The liquid discharge apparatus according to claim 1, wherein the tank is provided outside the carriage, wherein the tank includes a first tube and a second tube, the first tube configuring the first connection channel and connected to the tank, the second tube configuring the second connection channel and connected to the tank, wherein the first channel portion is a portion of the first tube which extends toward one side in the scanning direction from an end of the first tube on a side of the liquid discharge head, and wherein the second channel portion is a portion of the second tube which extends toward the one side in the scanning direction from an end of the second tube on the side of the liquid discharge head.

3. The liquid discharge apparatus according to claim 2, wherein a magnitude relation between compliance of the first damper in a case that positive pressure is generated therein and compliance of the second damper in a case that positive pressure is generated therein is opposite to a magnitude relation between compliance of the first damper in a case that negative pressure is generated therein and compliance of the second damper in a case that negative pressure is generated therein.

4. The liquid discharge apparatus according to claim 3, wherein, in at least one of the first damper and the second damper, the compliance in the case that positive pressure is generated therein is different from the compliance in the case that negative pressure is generated therein.

5. The liquid discharge apparatus according to claim 4, wherein the compliance of the first damper in the case that positive pressure is generated therein is smaller than the compliance of the first damper in the case that negative pressure is generated therein.

6. The liquid discharge apparatus according to claim 5, wherein the first damper includes:

a first damper chamber configuring the first connection channel;

a first damper film functioning as a wall of the first damper chamber; and a first regulating portion disposed to face a surface of the first damper film on a side opposite to the first damper chamber and configured to regulate deformation of the first damper film toward the side opposite to the first damper chamber by coming into contact with the first damper film.

7. The liquid discharge apparatus according to claim 6, wherein the first damper further comprises a facing surface which faces the surface of the first damper film on the side opposite to the first damper chamber, and wherein the first regulating portion is a protrusion protruding toward the first damper film from the facing surface.

8. The liquid discharge apparatus according to claim 5, wherein the compliance of the second damper in the case that positive pressure is generated therein is larger than the compliance of the second damper in the case that negative pressure is generated therein.

9. The liquid discharge apparatus according to claim 8, wherein the second damper includes:

a second damper chamber configuring the second connection channel;

a second damper film functioning as a wall of the second damper chamber; and a second regulating portion disposed to face a surface of the second damper film on a side of the second damper chamber and configured to regulate deformation of the second damper film toward the side of the second damper chamber by coming into contact with the second damper film.

10. The liquid discharge apparatus according to claim 9, wherein the second regulating portion is a protrusion which protrudes toward the second damper film from an inner wall surface of the second damper chamber facing the second damper chamber.

11. The liquid discharge apparatus according to claim 2, wherein a magnitude relation between compliance of the first damper in a case that positive pressure is generated therein and compliance of the second damper in a case that positive pressure is generated therein is identical to a magnitude relation between compliance of the first damper in a case that negative pressure is generated therein and compliance of the second damper in a case that negative pressure is generated therein, wherein the liquid discharge apparatus further includes a controller configured to control the carriage so that moving velocity of the carriage in a case that the carriage moves toward the one side in the scanning direction is different from moving velocity of the carriage in a case that the carriage moves toward the other side in the scanning direction.

12. The liquid discharge apparatus according to claim 1, further comprising:

a tank-side channel connected to the tank and functioning as a part of the first connection channel and a part of the second connection channel;

a first branch channel branched from the tank-side channel and connected to the liquid discharge head so that the first branch channel is a part of the first connection channel; and a second branch channel branched from the tank-side channel and connected to the liquid discharge head so that the second branch channel is a part of the second connection channel.

13. The liquid discharge apparatus according to claim 1, wherein the at least one nozzle comprises a plurality of nozzles;

the liquid discharge head comprises:

a plurality of individual channels including the plurality of nozzles respectively;

a first common channel connected to the first connection channel; and a second common channel connected to the second connection channel, wherein each of the individual channels comprises:

a first communicating portion which allows each of the nozzles to communicate with the first common channel; and a second communicating portion which allows each of the nozzles to communicate with the second common channel.

14. The liquid discharge apparatus according to claim 1, wherein the tank is provided outside the carriage, wherein the tank comprises a first tube configuring the first connection channel and a second tube configuring the second connection channel, wherein the first channel portion is a portion of the first tube which extends toward one side in the scanning direction from an end of the first tube on a side of the liquid discharge head, and wherein the second channel portion is a portion of the second tube which extends toward the other side in the scanning direction from an end of the second tube on the side of the liquid discharge head.

15. The liquid discharge apparatus according to claim 14, wherein the tank comprises a first tank connected to the first tube and a second tank connected to the second tube.

16. The liquid discharge apparatus according to claim 14, wherein the at least one nozzle comprises a plurality of nozzles, wherein the liquid discharge head comprises:

a plurality of individual channels having the plurality of nozzles respectively;

a first common channel connected to the first connection channel; and a second common channel connected to the second connection channel, each of the individual channels comprises:

a first communicating portion which allows each of the nozzles to communicate with the first common channel; and a second communicating portion which allows each of the nozzles to communicate with the second common channel, wherein a ratio of a channel resistance of the first communicating portion to a channel resistance of the second communicating portion is R1:R2, and wherein a ratio of compliance of the first connection channel to compliance of the second connection channel is R2:R1.

17. The liquid discharge apparatus according to claim 1, wherein the at least one nozzle comprises a plurality of nozzles, wherein the liquid discharge head comprises:

a plurality of first individual channels having the plurality of nozzles;

a plurality of second individual channels having the plurality of nozzles;

a first common channel connected to the plurality of first individual channels and the first connection channel;

a second common channel connected to the plurality of second individual channels and the second connection channel; and a bypass channel which is different from the plurality of first individual channels and the plurality of second individual channels and which connects the first common channel and the second common channel.

18. The liquid discharge apparatus according to claim 1, further comprising a controller configured to control the liquid discharge head to perform non-discharge flushing in which a meniscus of the liquid in the at least one nozzle is vibrated during movement in the scanning direction of the carriage without causing the liquid discharge head to discharge the liquid.

19. The liquid discharge apparatus according to claim 1, wherein no pump is provided between the liquid discharge head and the tank.

20. The liquid discharge apparatus according to claim 1, wherein no check valve is provided between the liquid discharge head and the tank.

21. A head unit comprising:

a liquid discharge head having at least one nozzle and carried on a carriage configured to move in a scanning direction;

a first connection channel connecting the liquid discharge head and a tank storing liquid; and a second connection channel connecting the liquid discharge head and the tank and communicating with the first connection channel via the liquid discharge head, wherein the first connection channel comprises a first channel portion and a first damper, the first channel portion extending in the scanning direction and configured to move in the scanning direction together with the carriage, the first damper provided closer to the at least one nozzle than the first channel portion and configured to inhibit pressure change in the liquid, wherein the second connection channel comprises a second channel portion and a second damper, the second channel portion extending in the scanning direction and configured to move in the scanning direction together with the carriage, the second damper provided closer to the at least one nozzle than the second channel portion and configured to inhibit pressure change in the liquid, and wherein the first damper is different in compliance from the second damper.

* * * * *